US007332563B2

(12) United States Patent
Masuda et al.

(10) Patent No.: US 7,332,563 B2
(45) Date of Patent: Feb. 19, 2008

(54) POLYESTER BASED FIBER AND ARTIFICIAL HAIR USING THE SAME

(76) Inventors: Toshiyuki Masuda, 20-12, Yoneda-cho Shioichi, Takasago-shi, Hyogo 676-0806 (JP); Toyohiko Shiga, 431-3, Uozumi-cho Nishioka, Akashi-shi, Hyogo 674-0084 (JP); Toshihiro Kowaki, 5-2-23, Torikainishi, Settsu-shi, Osaka 566-0072 (JP)

( * ) Notice: Subject to any disclaimer, the term of this patent is extended or adjusted under 35 U.S.C. 154(b) by 693 days.

(21) Appl. No.: 10/482,646

(22) PCT Filed: Jul. 18, 2002

(86) PCT No.: PCT/JP02/07282

§ 371 (c)(1),
(2), (4) Date: Jan. 5, 2004

(87) PCT Pub. No.: WO03/008679

PCT Pub. Date: Jan. 30, 2003

(65) Prior Publication Data

US 2004/0195543 A1 Oct. 7, 2004

(30) Foreign Application Priority Data

| | | |
|---|---|---|
| Jul. 19, 2001 | (JP) | 2001-219934 |
| Jul. 23, 2001 | (JP) | 2001-221673 |
| Jul. 31, 2001 | (JP) | 2001-232238 |
| Sep. 20, 2001 | (JP) | 2001-287187 |
| Feb. 4, 2002 | (JP) | 2002-026533 |

(51) Int. Cl.
*C08G 63/183* (2006.01)

(52) U.S. Cl. ..... 528/308.1; 524/108

(58) Field of Classification Search ..... 524/108; 528/308.1

See application file for complete search history.

(56) References Cited

U.S. PATENT DOCUMENTS 4,123,420 A * 10/1978 Kyo et al. ..... 524/144
4,127,590 A 11/1978 Endo et al.

FOREIGN PATENT DOCUMENTS

| | | |
|---|---|---|
| EP | 403968 | 12/1990 |
| GB | 1558308 | 12/1979 |
| JP | 61-245309 | 10/1986 |
| JP | 10-219519 | 8/1998 |

OTHER PUBLICATIONS

Hayashibara et al. Chem. Abst. 134:238802 (2001).*
Cheung et al., Chem. Abst. 110:155405 (1989).*
Ako et al., Chem. Abst. 128:48372 (1997).*

* cited by examiner

*Primary Examiner*—Peter O'Sullivan
(74) *Attorney, Agent, or Firm*—Kenyon & Kenyon LLP

(57) ABSTRACT

The object of the invention is to provide polyester-based fiber which maintains physical properties of usual polyester fiber, such as heat resistance, strength and elongation and is excellent in setting ability with controlled gloss of the fiber, artificial hair using the same, a method of producing polyester-based fiber, and a method of producing artificial hair by using the same. To achieve the object, a composition obtained by melt-kneading polyalkylene terephthalate or a copolymerized polyester (A) based on polyalkylene terephthalate, polyarylate (B) and a phosphite compound (C) is melt-spun to form fiber. In the case of melt-kneading, the ester exchange reaction of components (A) and (B) is prevented due to the inhibitory effect of the component (C) on the ester exchange reaction, the heat resistance and physical properties of the fiber are not deteriorated, and a matte effect is brought about by formation of protrusions on the surface of the fiber.

17 Claims, 5 Drawing Sheets

POLYESTER BASED FIBER AND ARTIFICIAL HAIR USING THE SAME

RELATED APPLICATIONS

This is a 371 application of PCT/JP02/07282 filed on Jul. 18, 2002, claiming priority to Japanese Application No. 2001-219934 filed on Jul. 19, 2001, No. 2001-221673 filed on Jul. 23, 2001, No. 2001-232238 filed on jul. 31, 2001, No. 2001-287187 filed on Sep. 20, 2001 and No. 2002-026533 filed on Feb. 4, 2002, respectively, the entire contents of which are incorporated herein by reference.

TECHNICAL FIELD

The present invention relates to polyester-based fiber formed from a composition obtained by melt-kneading polyester, polyarylate and a phosphite compound and to artificial hair using the same.

Further, the present invention relates to a method of producing polyester-based fiber and a method of producing artificial hair using the same.

BACKGROUND ART

Fibers consisting of polyesters composed of polyethylene terephthalate or based on polyethylene terephthalate have excellent heat resistance and chemical resistance with high melting point and high modulus of elasticity, and are thus used widely in curtains, carpets, clothing, blankets, sheet texture, table cloths, upholstering texture for chairs, wall materials, artificial hair, interior materials for automobiles, outdoor reinforcing materials and safety nets.

Conventionally, human hair and artificial hair (modacrylic fibers, polyvinyl chloride fibers) have been used in hair articles such as wigs, hairpiece, extension hair, hair bundle and doll hair.

However, it comes difficult to provide human hair, thus increasing the importance of artificial hair. By virtue of flame retardancy, modacrylic fibers are often used as a material of artificial hair but are insufficient in respect of heat resistance. In recent years, fibers based on polyesters represented by polyethylene terephthalate came to be used as fibers for artificial hair because of their excellent tensile strength, heat resistance and good set retention.

Fiber for artificial hair should particularly exhibit suitable matting and color as fiber resembling human hair, in addition to characteristics such as easy setting, setting retention, combing of fiber and less discoloration with light, but the polyester fiber produced by spinning in a usual manner has a flat surface, and the refractive index thereof is as high as 1.72 in the axial direction of the fiber, and is also as high as 1.54 in a vertical direction (diameter direction) to the fiber axis, thus causing strong optical reflection to increase surface gloss, and the fiber cannot be used as artificial hair.

To solve this problem, techniques of matting the surface of polyester fiber have been proposed. For example, the surface of polyester fiber is roughened by forming a large number of fretting mars on the surface of polyester fiber to give artificial matted hair. However, the matted fiber obtained by this method is disadvantageous in that the strength of the fiber is reduced due to the fretting mars formed on the surface of the fiber. In addition, JP-A 63-12716 discloses polyester fiber for artificial hair obtained by treating polyester-based fiber containing fine particles based on silicon oxide, with an aqueous alkali solution to form specific fine protrusions on the surface of the fiber, as well as a method of producing the same.

However, the fiber obtained by this method has a surface with fine and too uniform protrusions and can thus not be sufficiently matted, thus exhibiting strong optical reflection upon receiving an inclined light, and therefore there is a limit to application thereof to artificial hair. When the amount of inorganic fine particles is increased or the size or number of protrusions on the surface of fiber is increased in order to achieve a sufficient matte effect, a large amount of the fine particles are incorporated into the starting polyester. Accordingly, it is said generally and empirically that the strength of spun fiber is deteriorated in proportion to the amount of fine particles contained in the fiber. The strength of artificial hair participates in durability of hairpieces, and the durability is decreased as the strength is reduced.

As a means of providing protrusions without incorporation of inorganic materials influencing the matting of fiber surfaces, a method of irradiating polyester-based fiber with a plasma light is known. However, this method requires approximately 3 steps, that is, a spinning step for forming raw filament, a plasma-treating step for forming protrusions on the outer surface of the raw filament, and a staining step for giving color to artificial hair having concave regions, resulting in low productivity. At present, the treatment time in each step is significantly varied, and thus regulation of each step is not easy, and production control is not easy. As a result, there is a disadvantage that artificial hair having uniform qualities cannot be obtained stably in high productivity.

Fiber from polyester such as polyethylene terephthalate is a combustible material, and is thus poor in flame resistant properties.

Conventionally, various attempts have been made to improve flame resistant properties of polyester fiber. For example, a method of making fiber from polyester comprising phosphorus atom-containing flame-retardant monomers copolymerized therein and a method which involves incorporating a flame retardant into polyester fiber are known.

As the former method which involves copolymerizing flame-retardant monomers, there is proposed a method which involves copolymerizing a phosphorus compound excellent in heat stability containing a phosphorus atom as a ring member (JP-B 55-41610), a method which involves copolymerizing carboxyphosphinic acid (JP-B 53-13479) or a method which involves blending or copolymerizing a phosphorus compound with polyarylate-containing polyester (JP-A 11-124732).

As the latter method which involves incorporating a flame-retardant, there is proposed a method which involves incorporating fine particles of a halogenated cycloalkane compound into polyester fiber (JP-B 3-57990), a method which involves incorporating bromine atom-containing alkylcyclohexane (JP-B 1-24913), a method which involves forming polyester fiber from a polyester-based resin composition containing a phosphorus-based flame-retardant and a triazine-type compound (JP-A 11-335927) or a method of using a composition comprising polymeric polyphosphate incorporated into thermoplastic resin (JP-A 8-120180).

To apply the flame-retardancy techniques described above to artificial hair, polyester fiber comprising a phosphorus compound copolymerized therein has been proposed (JP-A 3-27105, JP-A 5-339805 etc.).

However, the artificial hair requires high flame resistant properties so that the amount of the phosphorus compound copolymerized should be increased in order to use the copolymerized polyester fiber as artificial hair, and as a result, the heat resistance of the polyester is significantly deteriorated thus making melt-spinning difficult, or the polyester may not be ignited or combusted upon approaching flame, but suffers from another problem of melting and dripping.

Significant "extinction by dripping" of the polyester fiber comprising a phosphorus compound copolymerized therein is not preferable for application to artificial hair.

On the other hand, the method of incorporating a flame-retardant into polyester fiber suffers from a problem that the temperature for incorporation of the flame-retardant should be as high as 150° C. or more in order to achieve sufficient flame resistant properties, the treatment time for incorporation should be long, or the flame retardant should be used in a large amount, resulting in problems such as a deterioration in physical properties of the fiber, lower productivity, and higher production costs.

As described above, there has not been obtained suitably matted artificial hair which maintains physical properties of usual polyester fiber, such as heat resistance, strength and elongation and is excellent in flame resistant properties, dripping resistance and setting ability. There is demand for a method of efficiently producing artificial hair at low costs.

DISCLOSURE OF THE INVENTION

The present invention relates to polyester-based fiber comprising a composition containing (A) polyester consisting of at least one kind of polyalkylene terephthalate or at least one kind of copolymerized polyester based on polyalkylene terephthalate, (B) polyarylate and (C) a phosphite compound.

Preferably, the ratio by weight of the polyester (A) to the polyarylate (B), that is, (A)/(B), is from 90/10 to 70/30, and the amount of the phosphite compound (C) added is 0.05 to 5 parts by weight based on 100 parts in total of the polyester (A) and polyarylate (B).

The polyester (A) is preferably at least one polymer selected from the group consisting of polyethylene terephthalate, polypropylene terephthalate and polybutylene terephthalate.

The polyester-based fiber according to claim 1, wherein the polyarylate (B) is polyarylate obtained from a mixture of terephthalic acid, a derivative thereof, isophthalic acid and a derivative thereof, and a bisphenol compound represented by the general formula (1):

(1)

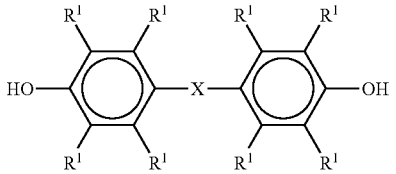

wherein $R^1$ groups represent a hydrogen atom or a $C_{1-10}$ hydrocarbon group, and may be the same or different, and X represents a methylene group, ethylidene group, isopropylidene group, carbonyl group, sulfonyl group, 1,3-phenylenediisopropylidene group or 1,4-phenylenediisopropylidene group.

Preferably, the phosphite compound (C) is at least one member selected from the group consisting of trialkyl pohsphites, triallyl phosphites, alkylallyl phosphites and the phosphite compounds represented by the general formulae (2) to (5):

(2)

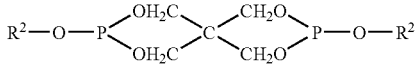

wherein $R^2$ groups represent a $C_{4-20}$ linear or branched hydrocarbon group, and may be the same or different, (3)

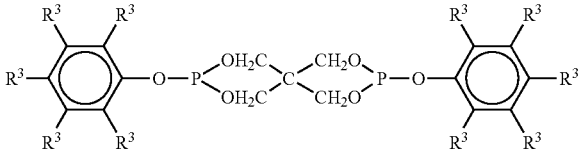

wherein $R^3$ groups represent a hydrogen atom or a $C_{1-10}$ hydrocarbon group, and may be the same or different, (4)

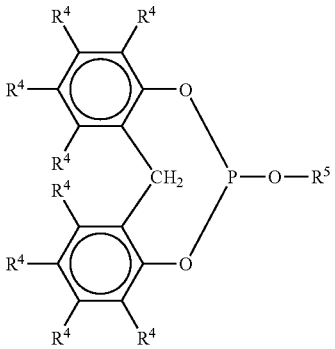

wherein $R^4$ groups represent a hydrogen atom or a $C_{1-10}$ hydrocarbon group, and may be the same or different, and $R^5$ represents a $C_{4-20}$ hydrocarbon group or a $C_{6-20}$ aromatic hydrocarbon group, (5)

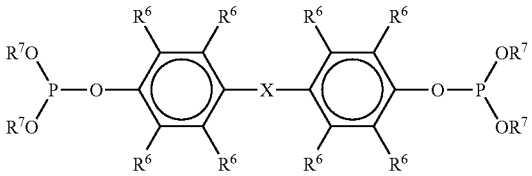

wherein $R^6$ groups represent a hydrogen atom or a $C_{1-10}$ hydrocarbon group, and may be the same or different, $R^7$ groups represent a $C_{4-20}$ hydrocarbon group or a $C_{6-20}$ aromatic hydrocarbon group, and may be the same or different, and X represents a methylene group, ethylidene group, isopropylidene group, carbonyl group, sulfonyl group, 1,3-phenylenediisopropylidene group or 1,4-phenylenediisopropylidene group.

Preferably, the polyarylate (B) having dimensions of 0.1 to 15 μm in diameter and 0.05 to 10 μm in short diameter is dispersed in the polyester (A).

Preferably, the components (A), (B) and (C) are melt-kneaded by a twin-screw extruder under the conditions of a kneading temperature of 240 to 310° C. and a Q/R value of 0.2 to 2.0.

Also, the present invention relates to the polyester-based fiber wherein the composition further comprises a flame retardant.

Preferably, the flame retardant is a phosphorus based flame retardant (D).

Preferably, the ratio by weight of the polyester (A) to the polyarylate (B), that is, (A)/(B), is from 90/10 to 70/30, and the amount of the phosphorus based flame retardant (D) added is 0.05 to 10 parts by weight in terms of phosphorus atom.

Preferably, the component (D) is at least one compound selected from the group consisting of a phosphate compound, a phosphonate compound, a phosphinate compound, a phosphine oxide compound, a phosphonite compound, a phosphinite compound, a phosphine compound and a condensed phosphate compound.

Preferably, the component (D) is a condensed phosphate compound represented by the general formula (6):

(6)

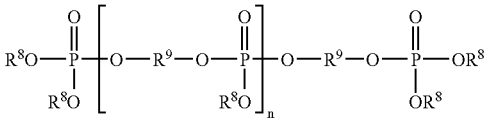

wherein $R^8$ groups represent a monovalent aromatic hydrocarbon group or aliphatic hydrocarbon group, and may be the same or different; $R^9$ represents a divalent aromatic hydrocarbon group, and when two or more $R^9$ groups are present, the groups may be the same or different; and n is 0 to 15.

Further, the present invention relates to the polyester-based fiber wherein the flame retardant is a reactive phosphorus based flame retardant.

Preferably, the component (A) is a copolymerized thermoplastic polyester comprising a reactive phosphorus based flame retardant copolymerized therein.

Preferably, the reactive phosphorus based flame retardant is at least one member selected from the group consisting of phosphorus-containing compounds represented by the general formulae (7) to (12):

(7)

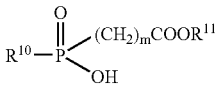

wherein $R^{10}$ represents a $C_{1-20}$ aliphatic hydrocarbon group or a $C_{6-12}$ aromatic hydrocarbon group, $R^{11}$ represents a hydrogen atom or a $C_{1-20}$ aliphatic hydrocarbon group, and m is an integer of 1 to 11, (8)

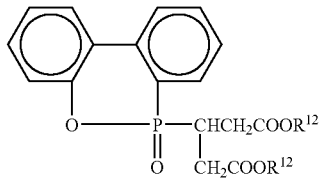

wherein $R^{12}$ groups represent a hydrogen atom or a $C_{1-20}$ aliphatic hydrocarbon group, and may be the same or different, (9)

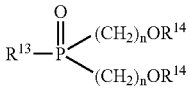

wherein $R^{13}$ groups represent a $C_{1-20}$ aliphatic hydrocarbon group or a $C_{6-12}$ aromatic hydrocarbon group, $R^{14}$ groups represent a hydrogen atom or a $C_{1-20}$ aliphatic hydrocarbon group, and may be the same or different, and n is an integer of 1 to 12, (10)

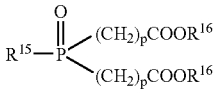

wherein $R^{15}$ represents a $C_{1-20}$ aliphatic hydrocarbon group or a $C_{6-12}$ aromatic hydrocarbon group, $R^{16}$ groups represent a hydrogen atom or a $C_{1-20}$ aliphatic hydrocarbon group, and may be the same or different, and p is an integer of 1 to 11, (11)

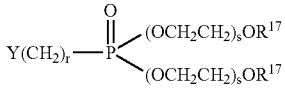

wherein $R^{17}$ groups represent a hydrogen atom or a $C_{1-20}$ aliphatic hydrocarbon group, and may be the same or different, Y represents a hydrogen atom, a methyl group or a $C_{6-12}$ aromatic hydrocarbon group, and r and s each represent an integer of 1 to 20, and (12)

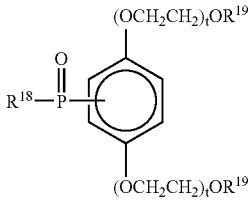

wherein $R^{18}$ represents a $C_{1-20}$ aliphatic hydrocarbon group or a $C_{6-12}$ aromatic hydrocarbon group, $R^{19}$ groups represents a hydrogen atom or a $C_{1-20}$ aliphatic hydrocarbon group, and may be the same or different, and t is an integer of 1 to 20.

Further, the present invention relates to a method of producing the polyester-based fiber, which comprises directly melt-spinning the composition by an extruder having a gear pump and spinnerets.

Preferably, the polyester-based fiber has fine protrusions on the surface of the fiber.

Preferably, the major axis of the protrusion is 0.2 to 20 μm, the minor axis is 0.1 to 10 μm, the height is 0.1 to 2 μm, and the number of protrusions per 100 $\mu m^2$ fiber surface is at least 1.

Flame-retardant, polyester-based fiber comprising the polyester-based fiber is preferable.

Artificial hair comprising the polyester-based fiber is preferable.

BEST MODE FOR CARRYING OUT THE INVENTION

Figure 1:
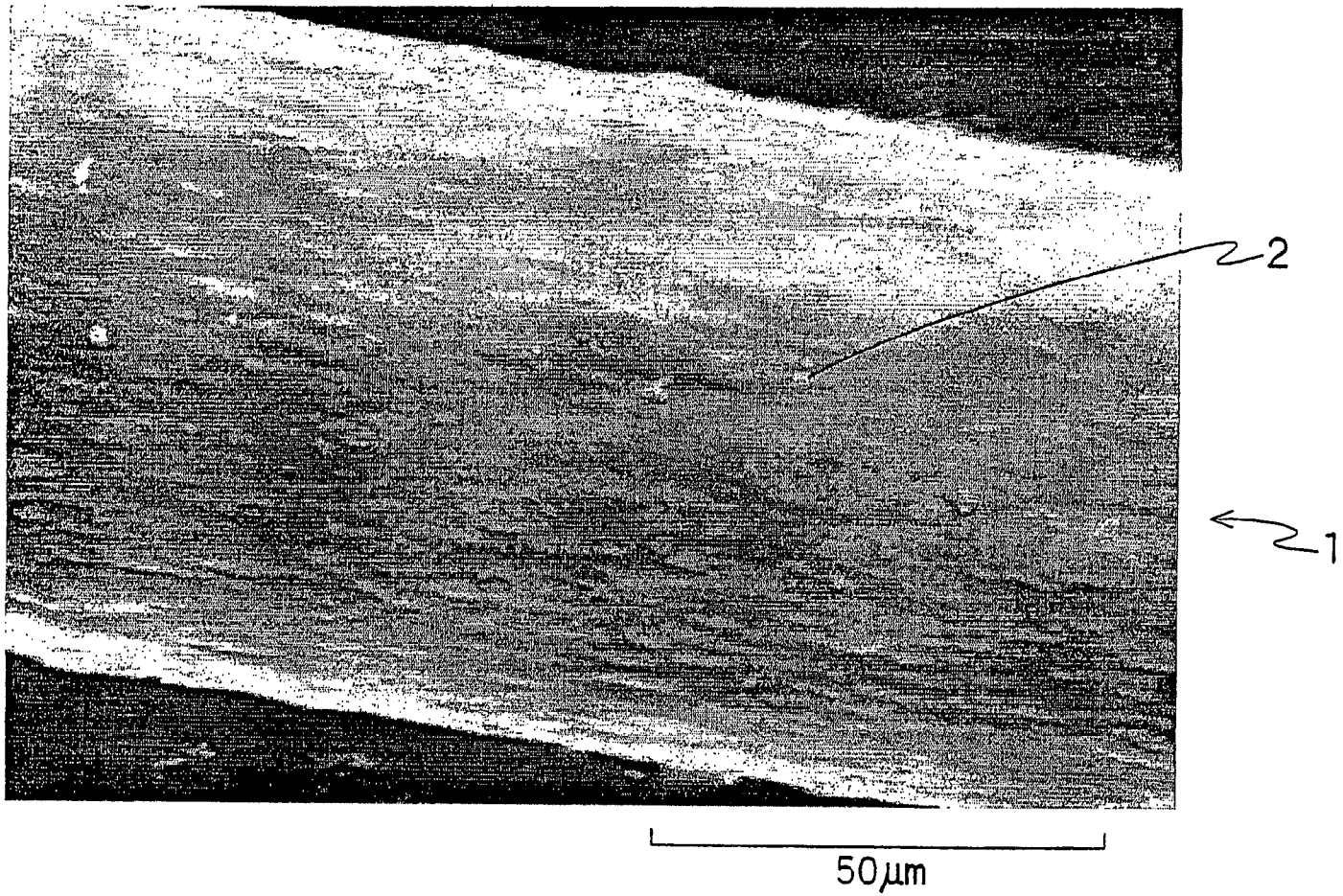
FIG. 1 is a photograph showing the surface of polyester-based fiber consisting of a composition comprising the polyester (A), the polyarylate (B) and the phosphite compound (C).

The polyester-based fiber of the present invention is a polyester-based fiber comprising a composition containing (A) polyester consisting of at least one kind of polyalkylene terephthalate or at least one kind of copolymerized polyester based on polyalkylene terephthalate, (B) polyarylate and (C) a phosphite compound.

In the present invention, the polyester (A) is a component used as a base polymer forming fibers, the polyarylate (B) is a component used for improving dripping resistance and flame retardancy, and the phosphite compound (C) is a component used for inhibiting ester exchange between the components (A) and (B). A composition obtained by melt-kneading these components has a sea island structure wherein the component (B) is dispersed in the component (A), and when the composition is melt-spun to form fibers, the resulting polyester-based fibers have fine protrusions on the surfaces thereof.

The copolymerized polyester composed of polyalkylene terephthalate or based on polyalkylene terephthalate, contained in the polyester (A) used in the present invention, includes for example polyalkylene terephthalate such as polyethylene terephthalate, polypropylene terephthalate and polybutylene terephthalate and/or a copolymerized polyester based on the polyalkylene terephthalate containing a small amount of copolymerizable components.

Among these compounds, polyethylene terephthalate, polypropylene terephthalate and polybutylene terephthalate are preferable in respect of heat resistance, mechanical properties, availability and costs.

The terms "based on" means that the component referred to is contained in an amount of 80 mol-% or more.

The copolymerizable components include, for example, polyvalent carboxylic acids such as isophthalic acid, orthophthalic acid, naphthalene dicarboxylic acid, paraphenylene dicarboxylic acid, trimellitic acid, pyromellitic acid, succinic acid, glutaric acid, adipic acid, suberic acid, azelaic acid, sebacic acid and dodecane diacid, derivatives thereof, dicarboxylic acids including sulfonates such as 5-sodium sulfoisophthalate and dihydroxyethyl 5-sodium sulfoisophthalate, derivatives thereof, 1,2-propanediol, 1,3-propanediol, 1,4-butanediol, 1,6-hexanediol, neopentyl glycol, 1,4-cyclohexane dimethanol, diethylene glycol, polyethylene glycol, trimethylol propane, pentaerythritol, 4-hydroxybenzoic acid, 6-caprolactone etc.

In respect of safety and easiness in operativeness, it is preferable that the copolymerized polyester is produced generally by reacting a small amount of a copolymerizable component with a polymer of a major starting material terephthalic acid and/or a derivative thereof (for example methyl terephthalate) and alkylene glycol. Alternatively, the copolymerized polyester may be produced by polymerizing a small amount of a copolymerizable monomer or oligomer component with a mixture of the major starting material terephthalic acid and/or a derivative thereof (for example methyl terephthalate) and alkylene glycol.

The copolymerized polyester may be a product having the copolymerizable component polycondensed with a major chain and/or a side chain of the major starting material polyalkylene phthalate, and there is no particular limit to the copolymerization method.

A polycondensation catalyst for the polyester (A) is preferably a germanium-based catalyst in respect of the stability of a composition obtained by melt-kneading, and when a catalyst such as an antimony-based catalyst is used, the resin may be decomposed in melt kneading or filaments may be cut in melt spinning.

Examples of the copolymerized polyester based on the polyalkylene terephthalate include polyesters based on polyethylene terephthalate, comprising isophthalic acid and/or a derivative thereof (for example, methyl isophthalate) or bisphenol A ethylene glycol ether copolymerized therein, 1,4-cyclohexane dimethanol copolymerized therein, or dihydroxyethyl 5-sodiumsulfoisophthalate copolymerized therein. Among these copolymerized polyesters, the polyester comprising bisphenol A ethylene glycol ether copolymerized therein and the polyester comprising 1,4-cyclohexane dimethanol copolymerized therein are preferable in respect of heat resistance and easiness in production.

The polyalkylene terephthalate and the copolymerized polyester may be used alone or as a mixture of two or more thereof. Preferable among these are polyethylene terephthalate, polypropylene terephthalate, polybutylene terephthalate and copolymerized polyesters (polyesters based on polyethylene terephthalate, comprising bisphenol A ethylene glycol ether copolymerized therein, 1,4-cyclohexane dimethanol copolymerized therein or dihydroxyethyl 5-sodium sulfoisophthalate copolymerized therein). The copolymerized polyester includes polyesters based on polyethylene terephthalate, comprising bisphenol A ethylene glycol ether copolymerized therein, 1,4-cyclohexane dimethanol copolymerized therein or dihydroxyethyl 5-sodium sulfoisophthalate copolymerized therein. A mixture of two or more thereof is also preferable.

The polyester (A) used may also be recycled polyethylene terephthalate obtained by recovering used PET bottles, washing them, crushing them into flakes and drying the flakes until the water content is reduced to 100 ppm or less.

The intrinsic viscosity of the polyester (A) component is preferably 0.5 to 1.4, more preferably 0.6 to 1.2. When the intrinsic viscosity is less than 0.5, the mechanical strength of the resulting fibers tends to be lowered, while the intrinsic viscosity is higher than 1.4, the melt viscosity is increased as the molecular weight is increased, thus making melt spinning difficult, the finiteness is uneven, and the Young's modulus is increased to harden the formed fibers.

As described above, the polyarylate (B) is a component used for improving dripping resistance and flame retardancy, which is a resin having high melting viscosity and flame retardancy. The component (B) having high melting viscosity is dispersed in the component (A) thereby improving dripping resistance.

The component (B) is an aromatic polyester comprising an aromatic dicarboxylic acid component and an aromatic diol component, which may be produced by an interfacial polymerization method, a solution polymerization method or a melt polymerization method.

The aromatic dicarboxylic acid component used in production of the component (B) includes, for example, polyvalent carboxylic acids such as terephthalic acid, isophthalic acid, orthophthalic acid, naphthalene dicarboxylic acid and paraphenylene dicarboxylic acid, derivatives thereof, dicarboxylic acids including sulfonates such as 5-sodium sulfoisophthalate, dihydroxyethyl 5-sodium sulfoisophthalate and derivatives thereof.

The aromatic diol component used in production of the component (B) includes, for example, divalent phenols represented by the general formula (1):

(1)

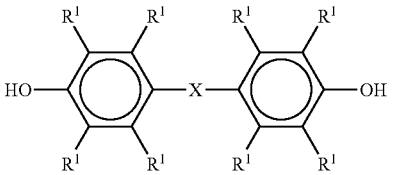

wherein $R^1$ groups represent a hydrogen atom or a $C_{1-10}$ hydrocarbon group, and may be the same or different, and X represents a methylene group, ethylidene group, isopropylidene group, carbonyl group, sulfonyl group, 1,3-phenylenediisopropylidene group or 1,4-phenylenediisopropylidene group, resorcinol, hydroquinone, biphenol, bis(4-hydroxyphenyl)methane, bis(4-hydroxyphenyl)ether, bis(4-hydroxyphenyl)sulfone, bis(4-hydroxyphenyl)sulfide, bis(4-hydroxyphenyl)sulfone, bis(4-hydroxyphenyl)ketone, bis(4-hydroxyphenyl)diphenylmethane, bis(4-hydroxyphenyl)-p-diisopropylbenzene, bis(3,5-dimethyl-4-hydroxyphenyl) methane, bis(3-methyl-4-hydroxyphenyl) methane, bis(3,5-dimethyl-4-hydroxyphenyl)ether, bis(3,5-dimethyl-4-hydroxyphenyl)sulfone, bis(3,5-dimethyl-4-hydroxyphenyl) sulfide, 1,1-bis(4-hydroxyphenyl)ethane, 1,1-bis(3,5-dimethyl-4-hydroxyphenyl)ethane, 1,1-bis(4-hydroxyphenyl)cyclohexane, 1,1-bis(4-hydroxyphenyl)-3,3,5-trimethylcyclohexane, 1,1-bis(4-hydroxyphenyl)-1-phenylethane, 2,2-bis(4-hydroxyphenyl)propane, 2,2-bis(4-hydroxyphenyl)butane, 2,2-bis(3,5-dimethyl-4-hydroxyphenyl)propane, 2,2-bis(3-methyl-4-hydroxyphenyl)propane, 4,4'-dihydroxybiphenyl, 3,3',5,5'-tetramethyl-4,4'-dihydroxybiphenyl, 4,4'-dihydroxybenzophenone 4,4'-dihydroxy-diphenyl ether, 4,4'-dihydroxy-diphenyl thioether etc.

The number of carbon atoms in $R^1$ is more preferably 1 to 4. When the number of carbon atoms in $R^1$ is greater than 10, the degree of polymerization tends to be lowered. X is preferably a methylene group, ethylidene group or isopropylidene group in respect of easiness of synthesis and costs.

In respect of heat resistance and mechanical properties, it is preferable that the polyarylate (B) comprising an aromatic dicarboxylic acid component and an aromatic diol component as described above is polyarylate obtained from a mixture of isophthalic acid and/or a derivative thereof and terephthalic acid and/or a derivative thereof, and at least one member selected from the compounds represented by the general formula (1).

The ratio of (isophthalic acid and/or a derivative thereof)/(terephthalic acid and/or a derivative thereof) is preferably 10/90 to 90/10, more preferably 20/80 to 80/20. When the ratio of isophthalic acid and/or a derivative thereof is less than 10, heat resistance is improved, but mechanical properties tend to be lowered due to significant brittleness, while when the ratio is greater than 90, heat resistance and mechanical properties tend to be lowered.

The intrinsic viscosity of the polyarylate (B) described above is preferably 0.5 to 1.4, more preferably 0.6 to 1.2. When the intrinsic viscosity is less than 0.5, the mechanical properties of the resulting fibers tend to be deteriorated, while when the intrinsic viscosity is higher than 1.4, the melt viscosity is increased as the molecular weight is increased, thus making melt spinning difficult, the fineness is uneven, and protrusions on the surfaces of the fibers are increased to cause a significant loss in gloss.

Examples of the polyarylate (B) include, for example, polyarylate obtained from bisphenol A, terephthalic acid and a derivative thereof, isophthalic acid and a derivative, polyarylate obtained from resorcinol, terephthalic acid and a derivative thereof, isophthalic acid and a derivative thereof, and polyarylate obtained from bisphenol, terephthalic acid and a derivative thereof, isophthalic acid and a derivative thereof. Among these compounds of the component (B), the polyarylate obtained from bisphenol A, terephthalic acid and a derivative thereof, and isophthalic acid and a derivative is preferable in respect of dispersibility in polyalkylene terephthalate, availability and costs.

The composition of the present invention has a sea island structure wherein the polyester (A) phase is the sea and the polyarylate (B) phase is an island. When the two components (A) and (B) are melt-kneaded, an ester exchange reaction therebetween can occur so that when the kneading time is shortened to inhibit the ester exchange reaction, the composition is not uniformly and finely dispersed, while when the kneading time is sufficiently long, the ester exchange reaction occurs to allow the composition to be uniformly mixed, thus making it difficult to form a sea island structure having the component (B) dispersed therein. Accordingly, a compound having an ability to inhibit an ester exchange reaction is preferably used to promote dispersion of the component (B) and to inhibit the ester exchange reaction. Such a compound is preferably the phosphite compound (C) in respect of its inhibitory effect on the ester exchange reaction.

The component (C) includes, for example, trialkyl phosphites, triallyl phosphites, alkylallyl phosphites, and phosphite compounds such as those phosphite-based antioxidants represented by the general formulae (2) to (5):

(2)

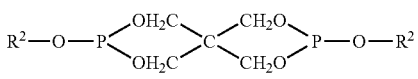

wherein $R^2$ groups represent a C4 to C20 linear or branched hydrocarbon group, and may be the same or different, the number of carbon atoms in $R^2$ is more preferably 4 to 14, and when the number of carbon atoms is less than 4, heat resistance and hydrolysis resistance are reduced, while when the number of carbon atoms is greater than 20, the inhibitory effect on ester exchange tends to be lowered because of a lower content of phosphorus atom, (3)

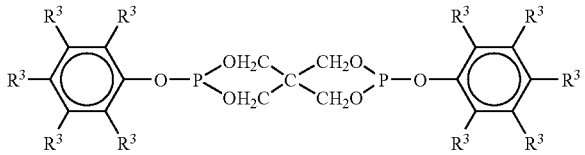

wherein $R^3$ groups represent a hydrogen atom or a C1 to C10 hydrocarbon group, and may be the same or different, the number of carbon atoms in $R^3$ is more preferably 1 to 4, and when the number of carbon atoms is greater than 10, the inhibitory effect on ester exchange tends to be lowered because of a lower content of phosphorus atom, (4)

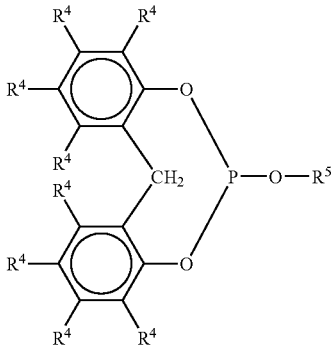

wherein $R^4$ groups represent a hydrogen atom or a C1 to C10 hydrocarbon group, and may be the same or different; $R^5$ is a C4 to C20 hydrocarbon group or a C6 to C20 aromatic hydrocarbon group; the number of carbon atoms in $R^4$ is more preferably 1 to 4, and when the number of carbon atoms is greater than 10, the inhibitory effect on ester exchange tends to be lowered because of a lower content of phosphorus atom; the number of carbon atoms in $R^5$ is more preferably 4 to 14, and when the number of carbon atoms is less than 4, heat resistance and hydrolysis resistance are reduced, while when the number of carbon atoms is greater than 20, the inhibitory effect on ester exchange tends to be lowered because of a lower content of phosphorus atom; the number of carbon atoms in the aromatic hydrocarbon group represented by $R^5$ is more preferably 6 to 14, and when the number of carbon atoms is less than 6, the compound is hardly synthesized because of instability, while when the number of carbon atoms is greater than 20, the inhibitory effect on ester exchange tends to be lowered because of a lower content of phosphorus atom, (5)

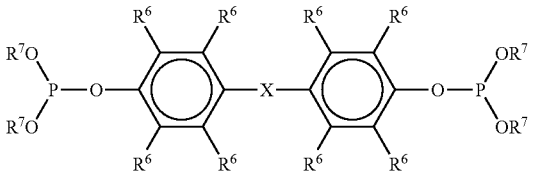

wherein $R^6$ groups represent a hydrogen atom or a C1 to C10 hydrocarbon group, and may be the same or different; $R^7$ groups represent a C4 to C20 hydrocarbon group or a C6 to C20 aromatic hydrocarbon group, and may be the same or different; and X represent a methylene group, ethylidene group, isopropylidene group, carbonyl group, sulfonyl group, 1,3-phenylene diisopropylidene group or 1,4-phenylene diisopropylidene group. The number of carbon atoms in $R^6$ is more preferably 1 to 4, and when the number of carbon atoms is greater than 10, the inhibitory effect on ester exchange tends to be lowered because of a lower content of phosphorus atom. The number of carbon atoms in the hydrocarbon group represented by $R^7$ is more preferably 4 to 14, and when the number of carbon atoms is less than 4, heat resistance and hydrolysis resistance are reduced, while when the number of carbon atoms is greater than 20, the inhibitory effect on ester exchange tends to be lowered because of a lower content of phosphorus atom. The number of carbon atoms in the aromatic hydrocarbon group represented by $R^7$ is more preferably 6 to 14, and when the number of carbon atoms is less than 6, the compound is hardly synthesized because of instability, while when the number of carbon atoms is greater than 20, the inhibitory effect on ester exchange tends to be lowered because of a lower content of phosphorus atom. X is preferably a methylene group, an ethylidene group or an isopropylidene group in respect of easiness of synthesis and costs.

Examples of the phosphite compound (C) i.e. the trialkyl phosphites, triallyl phosphites and alkylallyl phosphites described above and phosphite compounds such as the phosphite-based antioxidants represented by the general formulae (2) to (5) include, for example, trialkyl phosphites such as trioctyl phosphite, tridecanyl phosphite etc., alkylallyl phosphites such as triphenyl phosphite, tris(nonylphenyl)phosphite, tris(2,4-di(t-butyl)phenyl)phosphite, triallyl phosphites, decanyl phenyl phosphite, decanyl diphenyl phosphite, octyl diphenyl phosphite etc., and the phosphite-based antioxidants represented by the general formula (2) to (5) including compounds represented by the following formulae:

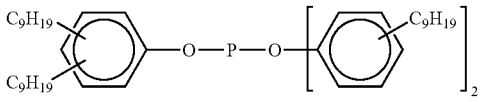

-continued

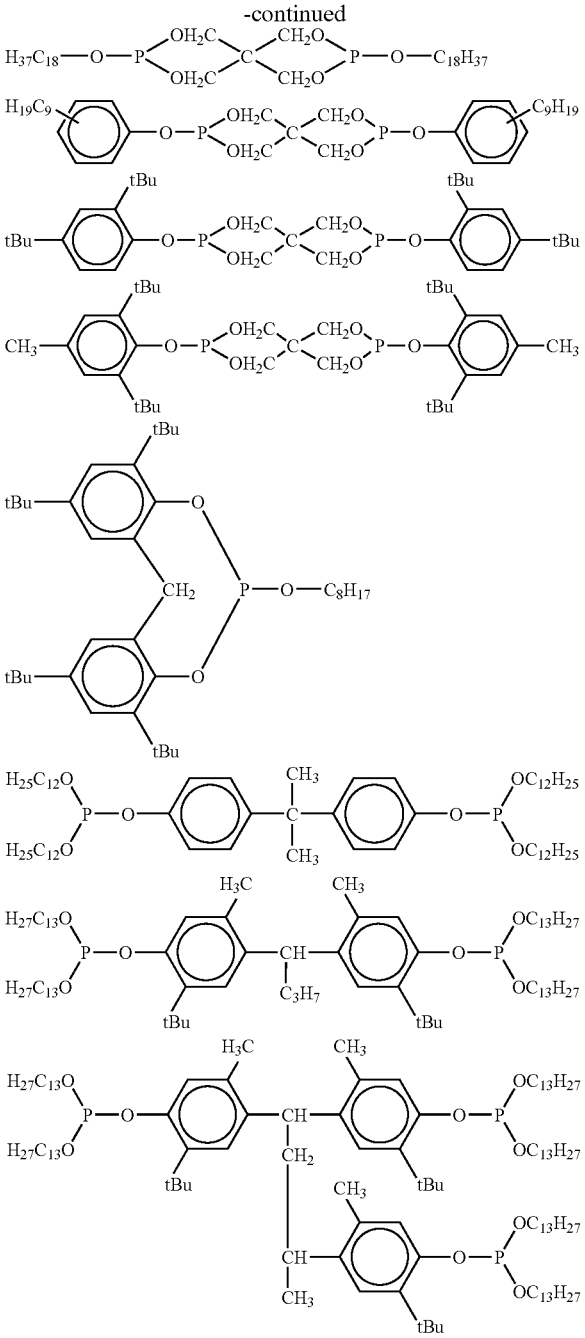

These compounds can be used alone or as a mixture of two or more thereof. Among these compounds, the phosphite-based antioxidants represented by the general formulae (2) to (5) are preferable because of their inhibitory effect on ester exchange between the components (A) and (B).

The ratio by weight of the polyester used as the component (A)/the polyarylate as the component (B) is 90/10 to 70/30, more preferably 88/12 to 75/25. When the ratio of the component (A) is greater than the above range, the protrusions of fiber surfaces are reduced and thus the matte effect cannot be sufficiently obtained, while when the ratio is smaller than the above range, the ester exchange reaction is hardly inhibited, and thus the mechanical properties are reduced, the matte effect cannot be sufficiently obtained, and the melt viscosity is too high, thus making melt spinning difficult.

The amount of the phosphite compound as the component (C) is preferably 0.05 to 5 parts by weight, more preferably 0.1 to 3 parts by weight, based on 100 parts by weight of the compounds (A) and (B) wherein (A)/(B) is 90/10 to 70/30. When the amount of the component (C) added is less than 0.05 part by weight, the ester exchange reaction is hardly inhibited, and thus the mechanical properties are reduced and the matte effect cannot be sufficiently obtained, while when the amount is greater than 5 parts by weight, heat resistance and mechanical properties of fibers are deteriorated, and the melt viscosity is reduced to cause filaments to be easily cut in melt spinning, thus making the process instable.

Preferably, the composition further comprises a flame retardant.

The flame retardant is preferably a phosphorus based flame retardant (D).

As the flame retardant, the phosphorus based flame retardant (D) is preferably used for lower toxicity.

The phosphorus based flame retardant (D) used in the present invention is not particularly limited, and any generally used phosphorus based flame retardants can be used.

The component (D) is preferably at least one compound selected from the group consisting of a phosphate compound, a phosphonate compound, a phosphinate compound, a phosphine oxide compound, a phosphonite compound, a phosphinite compound, a phosphine compound and a condensed phosphate compound.

The condensed phosphate compound includes, for example, condensed phosphate compounds represented by the general formula (6):

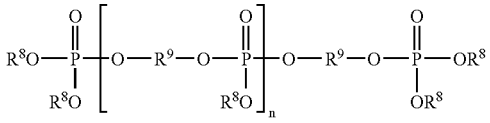

(6)

wherein $R^8$ groups represent a monovalent aromatic hydrocarbon group or aliphatic hydrocarbon group, and may be the same or different; $R^9$ represents a divalent aromatic hydrocarbon group, and when two or more $R^9$ groups are present, the groups may be the same or different; and n is 0 to 15. These condensed phosphate compounds may be used alone or as a mixture of two or more thereof. Among these compounds, the condensed phosphate compounds represented by the general formula (6) are preferable.

Examples of the phosphorus based flame retardant (D) include trimethyl phosphate, triethyl phosphate, tributyl phosphate, tri(2-ethylhexyl)phosphate, triphenyl phosphate, tricresyl phosphate, trixylenyl phosphate, tris(isopropylphenyl)phosphate, tris(phenylphenyl)phosphate, trinephthyl phosphate, cresylphenyl phosphate, xylenyl diphenyl phosphate, triphenyl phosphine oxide, tricresyl phosphine oxide, diphenyl methanephosphonate and diethyl phenylphosphonate, as well as resorcinol polyphenyl phosphate, resorcinol poly(di-2,6-xylyl)phosphate, bisphenol A polycresyl phosphate, hydroquinone poly(2,6-xylyl)phosphate, and condensed phosphate compounds represented by the general formula (6) including compounds represented by the formulae:

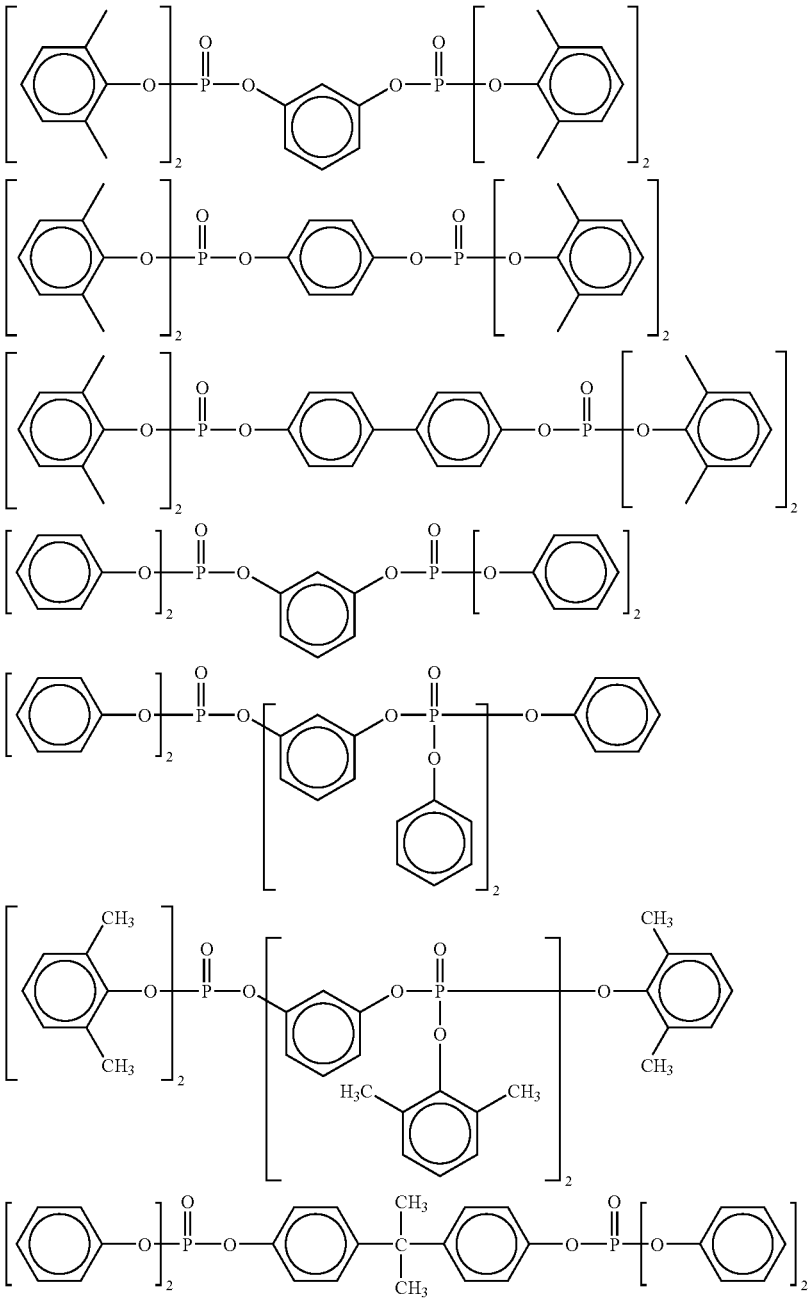

Among these compounds, the condensed phosphate compounds represented by the general formula (6) are preferable in respect of less influence on heat resistance, hydrolysis resistance, and physical properties of fibers.

As the component (D), the phosphorus based flame retardant is added such that the amount of the component (D), in terms of the amount of phosphorus atom, is preferably 0.05 to 10 parts by weight, more preferably 0.1 to 8 parts by weight, based on 100 parts by weight of the compounds (A) and (B) where the ratio by weight of the components (A) and (B), that is, (A)/(B) is 90/10 to 70/30. When the amount of the component (D) added is less than 0.05 part by weight, the flame retardant effect is hardly obtained, and when the amount of the component (D) is higher than 10 parts by weight, mechanical properties tend to be easily deteriorated.

The flame retardant is preferably a reactive phosphorus based flame retardant.

Use of a reactive phosphorus based flame retardant as the flame retardant is preferable to control bleedout during heating in heat treatment and iron setting.

The component (A) is preferably a thermoplastic copolymerized polyester (A) comprising a reactive phosphorus-based flame retardant copolymerized therein.

The thermoplastic copolymerized polyester (A) in the present invention is a component used as a base polymer for forming fibers, and the reactive phosphorus-based flame retardant contained as a copolymerizable component is used to confer flame retardancy.

In the thermoplastic copolymerized polyester (A) comprising a reactive phosphorus-based flame retardant copolymerized therein, used in the present invention, the polyester component other than the reactive phosphorus-based flame retardant is not limited insofar as it is polyester obtained by copolymerizing a general component forming thermoplastic polyester with a reactive phosphorus-based flame retardant. The polyester component is preferably a copolymerized polyester obtained by polycondensation of an aromatic dicarboxylic acid or an ester-forming derivative thereof with glycol or an ester-forming derivative and a reactive phosphorus-based flame retardant, and the polyester may also contain a small amount of other copolymerizable components.

The aromatic dicarboxylic acid or ester-forming derivatives thereof include, for example, dicarboxylic acids such as terephthalic acid, isophthalic acid, orthophthalic acid, naphthalene dicarboxylic acid and paraphenylene dicarboxylic acid and derivatives thereof, and dicarboxylic acids including sulfonates such as 5-sodium sulfoisophthalate and dihydroxyethyl 5-sodium sulfoisophthalate, and derivatives thereof. Among these compounds, terephthalic acid, isophthalic acid, naphthalene dicarboxylic acid and derivatives thereof are preferable in respect of reactivity, heat resistance, mechanical properties, availability and costs.

The glycol or ester-forming derivatives include, for example, ethylene glycol, 1,2-propanediol, 1,3-propanediol, 1,4-butanediol, 1,6-hexanediol, neopentyl glycol, 1,4-cyclohexane dimethanol, diethylene glycol, polyethylene glycol and derivatives thereof. Among these compounds, ethylene glycol, 1,3-propanediol, 1,4-butanediol and derivatives thereof are preferable in respect of reactivity, availability, and costs.

The components which can be copolymerized with the dicarboxylic acids and glycols described above include, for example, polyvalent carboxylic acids such as trimellitic acid, pyromellitic acid, succinic acid, glutaric acid, adipic acid, suberic acid, azelaic acid, sebacic acid and dodecane diacid and derivatives thereof, trimethylol propane, pentaerythritol, 4-hydroxybenzoic acid, ϵ-caprolactone etc.

The reactive phosphorus based flame retardant is not particularly limited insofar as it is copolymerizable with the dicarboxylic acids and glycols, to confer flame retardancy, and for example, use can be made of phosphorus-containing compounds represented by the general formulae (7) to (12) and derivatives thereof:

(7)

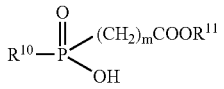

wherein $R^{10}$ represents a C1 to C20 aliphatic hydrocarbon group or a C6 to C12 aromatic hydrocarbon group, $R^{11}$ represents a hydrogen atom or a C1 to C20 aliphatic hydrocarbon group, m represents an integer of 1 to 11, and the number of carbon atoms in the aliphatic hydrocarbon group represented by $R^{10}$ is more preferably 1 to 8; when the number of carbon atoms is greater than 20, the content of phosphorus atom is lowered, and thus the amount of the flame retardant copolymerized should be increased to achieve flame retardancy, and heat resistance, mechanical properties and dripping resistance tend to be lowered; the number of carbon atoms in the aromatic hydrocarbon group represented by $R^{10}$ is more preferably 6 to 10; when the number of carbon atoms is less than 6, the compound tends to be instable to make copolymerization thereof difficult, and when the number of carbon atoms is greater than 12, the reactivity of the aromatic hydrocarbon compound tends to be lowered to make synthesis difficult; the number of carbon atoms in $R^{11}$ is more preferably 1 to 12; and when the number of carbon atoms is greater than 20, the reactivity is lowered to make copolymerization difficult, (8)

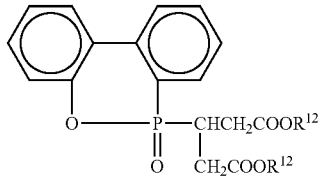

wherein $R^{12}$ groups represent a hydrogen atom or a C1 to C20 aliphatic hydrocarbon group, and maybe the same or different, the number of carbon atoms in $R^{12}$ is more preferably 1 to 12, and when the number of carbon atoms is greater than 20, the reactivity tends to be lowered to make copolymerization difficult, (9)

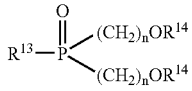

wherein $R^{13}$ represents a C1 to C20 aliphatic hydrocarbon group or a C6 to C12 aromatic hydrocarbon group, $R^{14}$ groups represent a hydrocarbon group or a C1 to C20 aliphatic hydrocarbon group, and may be the same or different, and n is an integer of 1 to 12; the number of carbon atoms in the aliphatic hydrocarbon group represented by $R^{13}$ is more preferably 1 to 8; when the number of carbon atoms is greater than 20, the content of phosphorus atom is lowered, and thus the amount of the flame retardant copolymerized should be increased to achieve flame retardancy, and heat resistance, mechanical properties and dripping resistance tend to be lowered; the number of carbon atoms in the aromatic hydrocarbon group represented by $R^{13}$ is more preferably 6 to 10; when the number of carbon atoms is less than 6, the compound tends to be instable to make copolymerization thereof difficult, and when the number of carbon atoms is greater than 12, the reactivity of the aromatic hydrocarbon compound tends to be lowered to make synthesis difficult; the number of carbon atoms in $R^{14}$ is more preferably 1 to 12; and when the number of carbon atoms is greater than 20, the reactivity is lowered to make copolymerization difficult, (10)

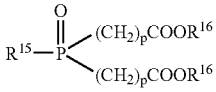

wherein $R^{15}$ represents a C1 to C20 aliphatic hydrocarbon group or a C6 to C12 aromatic hydrocarbon group, $R^{16}$ groups represent a hydrocarbon group or a C1 to C20 aliphatic hydrocarbon group, and may be the same or different, p is an integer of 1 to 11, and the number of carbon atoms in the aliphatic hydrocarbon group represented by $R^{15}$ is more preferably 1 to 8; when the number of carbon atoms is greater than 20, the content of phosphorus atom is lowered, and thus the amount of the flame retardant copolymerized should be increased to achieve flame retardancy, and heat resistance, mechanical properties and dripping resistance tend to be lowered; the number of carbon atoms in the aromatic hydrocarbon group represented by $R^{15}$ is more preferably 6 to 10; when the number of carbon atoms is less than 6, the compound tends to be instable to make copolymerization difficult, and when the number of carbon atoms is greater than 12, the reactivity of the aromatic hydrocarbon compound tends to be lowered to make synthesis difficult; the number of carbon atoms in $R^{16}$ is more preferably 1 to 12; and when the number of carbon atoms is greater than 20, the reactivity is lowered to make copolymerization difficult, (11)

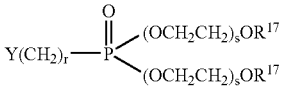

wherein $R^{17}$ groups represent a hydrogen atom or a C1 to C20 aliphatic hydrocarbon group, and may be the same or different, Y represents a hydrogen atom, a methyl group or a C6 to C12 aromatic hydrocarbon group, r and s each represent an integer of 1 to 20, and the number of carbon atoms in $R^{17}$ is more preferably 1 to 12; when the number of carbon atoms is greater than 20, the reactivity tends to be lowered to make copolymerization difficult; the number of carbon atoms in Y is more preferably 6 to 8; when the number of carbon atoms is less than 6, the compound tends to be instable to make copolymerization difficult, and when the number of carbon atoms is greater than 12, the reactivity of the aromatic hydrocarbon compound is lowered to make synthesis difficult, (12)

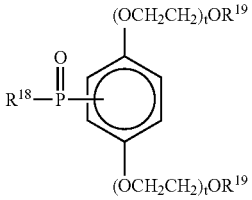

wherein $R^{18}$ groups represent a C1 to C20 aliphatic hydrocarbon group or a C6 to C12 aromatic hydrocarbon group, $R^{19}$ groups represent a hydrogen atom or a C1 to C20 aliphatic hydrocarbon group, and may be the same or different, t is an integer of 1 to 20, and the number of carbon atoms in the aliphatic hydrocarbon group represented by $R^{18}$ is more preferably 1 to 8; when the number of carbon atoms is greater than 20, the content of phosphorus atom is lowered, and thus the amount of the flame retardant copolymerized should be increased to achieve flame retardancy, and heat resistance, mechanical properties and dripping resistance tend to be lowered; the number of carbon atoms in the aromatic hydrocarbon group represented by $R^{18}$ is more preferably 6 to 10; when the number of carbon atoms is less than 6, the compound tends to be instable to make copolymerization difficult, and when the number of carbon atoms is greater than 12, the reactivity of the aromatic hydrocarbon compound is lowered to make synthesis difficult; the number of carbon atoms in $R^{19}$ is more preferably 1 to 12; and when the number of carbon atoms is greater than 20, the reactivity is lowered to make copolymerization difficult.

Examples of the reactive phosphorus based flame retardant include diethyl-N,N-bis(2-hydroxyethyl)aminomethylphosphonate, 2-methacryloyloxyethyl acid phosphate, diphenyl-2-methacryloyloxyethyl phosphate, tris(3-hydroxypropyl)phosphine, tris(4-hydroxybutyl)phosphine, tris(3-hydroxypropyl)phosphine oxide, tris(3-hydroxybutyl)phosphine oxide, 3-(hydroxyphenylphosphinoyl)propionic acid, and phosphorus-containing compounds represented by the following formulae:

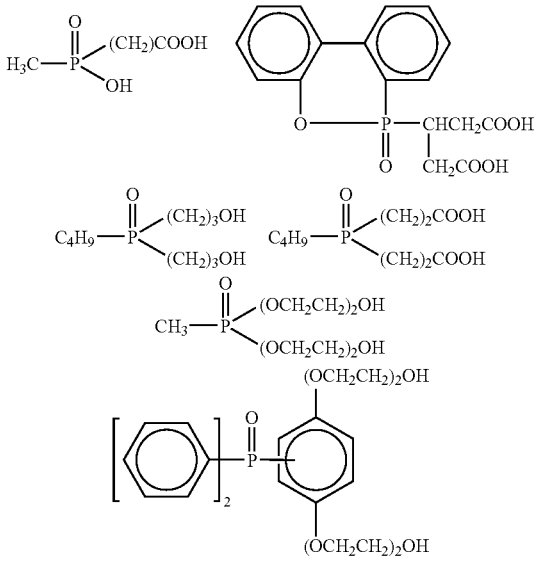

Among these compounds, the compounds represented by the general formulae (7) to (12) are preferable and the phosphorus-containing compounds represented by the above chemical formulae are more preferable in respect of copolymerizability, heat resistance, and physical properties of fibers.

The reactive phosphorus based flame retardants may be used alone or as a mixture of two or more thereof.

The amount of the reactive phosphorus based flame retardant used in the component (A) is in the range of 0.01 to 8% by weight, more preferably 0.05 to 5% by weight, still more preferably 0.1 to 3% by weight, in terms of the amount of phosphorus atom. When the amount is less than 0.01% by weight, the flame retardant effect is hardly obtained, while when the amount is higher than 8% by weight, mechanical properties tend to be deteriorated. Production of thermoplastic copolymerized polyester by copolymerizing the reactive phosphorus based flame retardant can be carried out by a known method, preferably by mixing a dicarboxylic acid, a derivative thereof, a diol component and a derivative thereof with the reactive phosphorus based flame retardant and then polycondensating the mixture, or by depolymerizing thermoplastic polyester with a diol component such as ethylene glycol in the presence of the reactive phosphorus based flame retardant during depolymerization, and then polycondensating the mixture to give a copolymer.

The components (A), (B) and (C) are melt-kneaded with a twin-screw extruder under the conditions of a kneading temperature of 240 to 310° C. and a Q/R value of 0.2 to 2.0.

In the present invention, the component (B) is finely dispersed in the component (A) to exhibit an excellent effect such as dripping resistance, and accordingly kneading conditions at the time of melt kneading are important. Hereinafter, preferable conditions are described.

The kneading temperature at the time of melt kneading is preferably 240 to 310° C., more preferably 250 to 300° C. When the kneading temperature is lower than 240° C., the composition cannot be sufficiently molten, thus making kneading insufficient or increasing loading on an extruder to make kneading impossible. On the other hand, when the temperature is higher than 310° C., the decomposition of the composition may be promoted to lower the melt viscosity of the composition, and the resulting composition may give fibers poor in physical properties.

Melt kneading is carried out under conditions where the degree of mixing (Q/R) is preferably 0.2 to 2.0, more preferably 0.3 to 1.8, wherein Q/R indicates a degree of melt kneading where Q is throughput (kg/hr) and R is the number of screw revolutions (rpm) in a twin-screw extruder having a screw diameter (D) of 40 to 100 mm. A lower degree of mixing (Q/R) indicates sufficient kneading, while a higher degree indicates insufficient kneading. When Q/R is smaller than 0.2, the component (B) is aggregated in an extremely dispersed state, resulting in poor dispersion of the component (B). When Q/R is greater than 2.0, the component (B) cannot be sufficiently dispersed, thus increasing the diameter of the dispersed component (B), and thus the resulting fibers have great protrusions on the surfaces thereof to deteriorate gloss, or filaments may be cut in spinning or stretching.

The kneader used in the present invention may be a general kneader such as a single-screw extruder, a twin-screw extruder, a roll, a Banbury mixer and a kneader, but from the viewpoint of mixing ability, control of the degree of mixing, and easiness of the operation, the kneader is preferably a twin-screw extruder or an intermeshing twin-screw extruder, more preferably a twin-screw extruder having an L/D value of 15 to 50. The L/D value, which is determined from the screw length (L)/screw diameter (D) of a twin-screw extruder, is a value intrinsic in the extruder. As the L value is increased, the retention time of the composition in the extruder is prolonged, and as a result, the kneading time of the composition is prolonged. As the D value is increased, the throughput capacity is increased. That is, the L/D value is an indicator of the kneading ability of the kneader, and as the L/D value is increased, the kneader can give higher shear stress to the composition to knead it at a higher level.

When the L/D value is smaller than 15, the screw length is so short that melting tends to be insufficient, thus failing to achieve a desired kneading effect. When the L/D value is greater than 50, the composition may be aggregated in an extremely dispersed state, resulting in poor dispersion of the component (B). When the L/D value is as low as 25 or less, the component (B) may not be sufficiently dispersed by kneading conducted once, and thus kneading is conducted preferably twice or more.

Dispersion of the component (B) is affected by the melt viscosity and solubility parameter of the components (A) and (B), and the diameter of the dispersed component (B) where the component (D) is mixed from the start of melt kneading is different from that of the component (B) where the components (A), (B) and (C) are melt-kneaded and then further melt-kneaded with the component (D). As compared with the former, the latter was found to achieve a smaller diameter of the dispersed component (B), to give fibers having surfaces with less protrusions. By finely dispersing the component (B), dripping resistance is further improved. In the case of kneading conducted once, therefore, it is preferable in the present invention that a twin-screw extruder having an L/D value of 25 to 50 having two inlets is used, and a mixture of the components (A), (B) and (C) is introduced through the first inlet and then the component (D) is introduced through the second inlet to melt-knead the composition, whereby the component (B) is dispersed more finely to improve dripping resistance. In the case of kneading conducted twice, it is preferable that a twin-screw extruder having an L/D value of 15 to 25 is used, and a mixture of the components (A), (B) and (C) is melt-kneaded in a first step and then the component (D) is added to the composition obtained in the first step, and melt-kneaded in a second step.

When the components (A), (B) and (C) are melt-kneaded in the present invention, the components (A) and (B) are melt-kneaded while the ester exchange reaction therebetween is prevented by the inhibitory effect of the phosphite-based antioxidant as the component (C), and thus the resulting composition gives fibers having a sea island structure wherein the component (B) is finely divided in the component (A). The particle diameter of the finely divided component (B) is determined according to L/D, kneading temperature, Q/R etc. The particle diameter of the component (B) affects fiber characteristics such as dripping resistance, and dispersed particles of the component (B) form uneven fine protrusions on the surfaces of fibers.

The particle diameter of the component (B) dispersed in the composition after kneading is preferably as follows: The major axis is in the range of 0.1 to 15 μm and the minor axis in the range of 0.05 to 10 μm, more preferably the major axis is 0.15 to 12 μm and the minor axis in the range of 0.08 to 8 μm, and still more preferably the major axis is 0.15 to 10 μm and the minor axis in the range of 0.08 to 5 μM. When the particle diameter of the component (B) is too small, the composition tends to be aggregated in an extremely dispersed state, resulting in poor dispersion, while when the particle diameter is too great, the resulting fibers have too great protrusions on the surfaces thereof, thus causing a loss in gloss and cutting of filaments at the time of spinning and stretching. The average number of dispersed particles of the component (B) is preferably 1 to 40, more preferably 2 to 30, per 100 $\mu m^2$ of the fiber surface. When the average number of dispersed particles of the component (B) is less than 1 per 100 $\mu m^2$ of the fiber surface, the fiber surface becomes too smooth, thus making the matte effect insufficient, while when the number exceeds 40, protrusions tend to be significant to cause a loss in gloss. When the component (B) is melt-spun in an insufficiently dispersed state, the components (A) and (B) undergo microscopic phase separation, and regions of low melt viscosity and regions of high melt viscosity occur unevenly, and thus the regions of low melt viscosity easily drip with approaching flame, resulting in deterioration in the dripping resistance of fibers. On the other hand, the component (B) is finely dispersed in the composition used in the present invention, and thus when the composition is melt-spun to form fibers, the component (B) is uniformly and finely dispersed, and the interfacial area between the components (A) and (B) is increased so that by interaction between the components (A) and (B), the melt viscosity is maintained high in the entire system, resulting in improvements in dripping resistance.

In the present invention, the major and minor axes of the component (B) dispersed in the composition can be determined for example by taking a photograph with a transmission electron microscope (TEM) and measuring the size, or other methods may be used.

The polyester-based fibers and the composition for artificial hair according to the invention may if necessary contain various additives such as a flame retardant other than the component (C), a heat-resistant material, a light stabilizer, a fluorescent agent, an antioxidant, an antistatic agent, a pigment, a plasticizer and a lubricant.

The polyester-based fibers in the invention can be produced by melt-spinning in usual melt-spinning methods, among which the composition is preferably melt-spun directly with an extruder having a gear pump and spinnerets.

The direct melt-spinning of the composition with an extruder having a gear pump and spinnerets is preferable because the pyrolysis and deterioration of the composition can be prevented, the process can be reduced, the productivity can be improved, and the cost can be reduced.

Preferably, the polyester-based fibers of the invention are produced by direct spinning, that is, by dry-blending the components (A), (B) and (C) followed by simultaneous melt-kneading and melt-spinning thereof with a twin-screw extruder and/or a tandem extruder having a gear pump and spinnerets. Usual polyester fibers are produced by melt-spinning with a single-screw extruder having a gear pump and spinnerets.

When the composition comprising the components (A), (B) and (C) as shown in the present invention is used to produce polyester-based fibers, a conventional method generally involves producing the composition with e.g. a twin-screw extruder for mixing the components uniformly in the composition and then melt-spinning pellets of the resulting composition, but melt-kneading, melt-spinning and heating, and melting are repeatedly carried out in this method, which can leads to pyrolysis and hydrolysis of the components and deterioration in physical properties and other qualities of fibers.

In the production method of the invention, therefore, the composition is formed into fibers by melt-spinning it directly with an extruder having a gear pump and spinnerets to give polyester-based fibers.

Hereinafter, preferable melt-spinning conditions therefor are described. In production of a twin-screw extruder having a gear pump and spinnerets in the present invention, the L/D value of the twin-screw extruder is preferably 20 to 50. When the L/D value is smaller than 20, the components cannot be sufficiently kneaded, thus making the component (B) dispersed unevenly, to cause a reduction in dripping resistance and in the matte effect, while when the L/D value is greater than 50, the retention time is prolonged, and therefore the ester exchange reaction between the components (A) and (B) is hardly prevented and the components (A) and (B) are mixed too uniformly, thus making control of fiber gloss difficult. In the twin-screw extruder, melt-kneading and spinning are conducted preferably under the conditions of 240 to 310° C. and a Q/R value of 0.5 to 3.0. When the kneading temperature is lower than 240° C., uniform kneading is difficult because of insufficient melting, while when the temperature is higher than 310° C., pyrolysis of the composition may be caused. When the Q/R value is smaller than 0.5, the retention time is prolonged, and thus the ester exchange reaction between the components (A) and (B) tends to be hardly suppressed, while when the Q/R value is greater than 3.0, kneading tends to be insufficient.

In production with the tandem extruder having a gear pump and spinnerets, a first extruder in the tandem extruder is a twin-screw extruder having an L/D value of 20 to 40, and a second extruder is a single-screw extruder having an L/D value of 40 or less. In a preferable mode, the composition is kneaded at 240 to 310° C. at a Q/R value of 0.5 to 2.5 in the first extruder, and then melt-spun at 220 to 300° C. in the second extruder. When the L/D value of the first extruder is smaller than 20, the components cannot be sufficiently kneaded, thus making the component (B) dispersed unevenly, to cause a reduction in dripping resistance and in the matte effect, while when the L/D value is greater than 40, the retention time is prolonged, and therefore the ester exchange reaction between the components (A) and (B) is hardly prevented and the components (A) and (B) are mixed uniformly to make control of fiber gloss difficult. When the kneading temperature is lower than 240° C., uniform kneading is difficult because of insufficient melting, while when the temperature is higher than 310° C., pyrolysis of the composition is caused. When the Q/R value is smaller than 0.5, the retention time is prolonged, and therefore the ester exchange reaction between the components (A) and (B) is hardly prevented, while when the Q/R value is greater than 2.5, kneading is insufficient. When the L/D value of the second extruder is greater than 40, the retention time is prolonged, and therefore the ester exchange reaction between the components (A) and (B) is hardly prevented. When the kneading temperature is lower than 220° C., the melt viscosity is increased to make spinning difficult, while when the temperature is higher than 300° C., the melt viscosity tends to be lowered to cause uneven finiteness and cutting of filament.

The conditions for melt-spinning are as follows: Melt-spinning is carried out under the conditions described above, then the resulting spun filament is passed through a heating cylinder, cooled to its glass transition point or less and drawn at a rate of 50 to 5000 m/min. The spun filament can be cooled in a water bath containing cooling water in order to control finiteness. The temperature and length of the heating cylinder, the temperature and feed rate of cooling air, the temperature of the cooling water bath, cooling time and take-off speed can be regulated suitably by the throughput rate and the number of spinnerets.

The resulting spun filament is subjected to hot stretching where stretching may be carried out by a two-step method which involves winding the spun filament and then stretching it, or by a direct spinning stretching method which involves continuously stretching the spun filament without winding it. Hot stretching is carried out by a method of stretching in one step or by a method of stretching in two or more steps. The heating device in hot stretching may be a heating roller, a heat plate, a steam jetting device and a hot water bath, and these can be suitably combined.

The hot-stretched spun filament can be heat-treated to improve dimensional stability and heat resistance. In heat treatment of the stretched filament, a heating roller, a heat plate and a hot-air oven can be used, and the filament can be treated in a stretched or relaxed state.

In melt-kneading the components (A), (B) and (C) in the present invention, the components (A) and (B) can be melt-kneaded without undergoing ester exchange reaction because of the inhibitory effect of the phosphite-based antioxidant as the component (C) on ester exchange reaction. The resulting composition can be melt-spun to give fibers having a sea island structure wherein the component (B) is finely dispersed in the component (A) to form protrusions made of the particulate component (B), and these protrusions bring about the matte effect. The size of protrusions formed on the surfaces of fibers is determined by the particle diameter of the finely dispersed component (B), and the particle diameter is determined according to conditions for melt-kneading and melt-spinning.

The major axis of fine protrusions formed on the surfaces of fibers is preferably 0.2 to 20 μm, more preferably 0.4 to 15 μm. The minor axis is preferably 0.1 to 10 μm, more preferably 0.2 to 8 μm. The height of protrusions is preferably 0.1 to 2 μm, more preferably 0.2 to 1.5 μm. The number of protrusions per 100 $\mu m^2$ of the fiber surface is preferably 1, more preferably 2.

When the major axis is smaller than 0.2 μm, the matte effect is insufficient, while when the diameter is greater than 20 μm, the feel of fibers and combing thereof tend to be lowered. When the minor axis is smaller than 0.1 μm, the matte effect is insufficient, while when the minor axis is greater than 10 m, the feel of fibers tends to be lowered. When the height of the protrusions is less than 0.1 μm, the matte effect is insufficient, while when the height is higher than 2 μm, combing of fibers tends to be deteriorated. When the number of protrusions per 100 $\mu m^2$ of the fiber surface is less than 1, the surfaces of fibers is too sooth, thus making the matte effect insufficient.

The conditions for manufacturing the polyester-based fibers of the invention are not particularly limited, and the fibers can be manufactured in the same manner as for usual polyester fibers, but the used pigment and assistants used are preferably those excellent in weatherability and flame retardancy.

The polyester-based fibers and artificial hair obtained in this manner are silk-like crimped fibers, and the fibers having a finiteness of usually 30 to 70 dtex, particularly 35 to 65 dtex, are preferable for artificial hair. As fibers for artificial hair, the polyester-based fibers have heat resistance to a hair heating device (hair iron) used at 160 to 180° C., are hardly ignited and have self-extinguishing properties.

The flame-retardant, polyester-based fibers formed from the composition of the invention are excellent in curling with a hair heating device (hair iron) and in retention of curling. The fibers are suitably matted due to the protrusions of their surfaces, and can be used as artificial hair. By using a lubricant such as a fiber surface-treating agent and a softener, the fibers can be endowed with good tough and feel to provide hair resembling human hair.

When the polyester-based fibers formed from the composition of the invention is used as artificial hair, the fibers may be used in combination with other materials for artificial hair, such as modacrylic fibers, polyvinyl chloride fibers and nylon fibers.

EXAMPLES

Hereinafter, the present invention is described in more detail by reference to the Examples, which however are not intended to limit the present invention.

The method of determining characteristic values is as follows:

(Intrinsic Viscosity of Polyester)

A solution of polyester at a concentration of 0.5 g/dl in a mixed solvent of equal weights of phenol and tetrachloroethane is measured for its relative viscosity at 25° C. with an Ubbellohde viscometer, and the intrinsic viscosity is calculated from the following formula:

$$[\eta] = \lim_{C \to 0} \eta_{sp}/C = \lim_{C \to 0} (\eta_{rel} - 1)/C = \lim_{C \to 0} (\eta - \eta_0)/\eta_0 C$$

wherein η is the viscosity of the solution, $\eta_o$ is the viscosity of the solvent, ηrel is relative viscosity, ηsp is specific viscosity, [η] is intrinsic viscosity, and C is the concentration of the solution.

(Intrinsic Viscosity of Polyarylate)

A solution of polyarylate at a concentration of 0.5 g/dl in a mixed solvent of equal weights of phenol and tetrachloroethane is measured for its relative viscosity at 25° C. with an Ubbellohde viscometer, and the intrinsic viscosity is calculated in the same manner as for the polyester. To determine the intrinsic viscosity of the polyarylate in each of Examples 1 to 14, a solution of the polyarylate at a concentration of 1.0 g/dl in a mixed solvent of phenol and tetrachloroethane in a ratio of 6/4 by weight is measured for its relative viscosity at 25° C. with an Ubbellohde viscometer, and the intrinsic viscosity is calculated in the same manner as for the polyester.

(Dispersibility of the Component (B))

A photograph of the composition after melt-kneading is taken under a transmission electron microscope (JEM-1200EX, JEOL. Ltd.) to measure the diameter of the dispersed component (B).

(Size of Protrusions on the Surfaces of Fibers)

A photograph of the surface of fiber is taken under a scanning electron microscope (SEM) S-3500N manufactured by Hitachi, Ltd. and evaluated with the naked eye to determine the size and number of protrusions on the fiber.

(Strength and Elongation)

The strength and elongation of a filament is measured with INTESCO Model 201 manufactured by INTESCO. A filament of 40 mm in length is used. The ends (10 mm each) of the filament are sandwiched between mounts (thin papers) adhesive-bonded with a double-coated tape, and then air-dried overnight, to prepare a sample of 20 mm in length. The sample is placed in a testing machine and examined at a temperature of 24° C. in humidity of 80% or less under a loading of 1/30 gf×finiteness (denier) at a stress rate of 20 mm/min., to determine strength and elongation. The test was carried out 10 times under the same conditions, and the average value is regarded as the strength and elongation of the filament.

(Heat Shrinkage)

The heat shrinkage of filaments is measured with SSC5200H thermal analysis TMA/SS150C manufactured by Seiko Denshi Kogyo Co., Ltd. A loading of 5.55 mg/dtex is applied to 10 filaments of 10 mm in length, and their heat shrinkage is measured in the range of 30 to 280° C. in an increasing temperature of 3° C./min.

(Cold Setting)

A 160-mm filament is stretched straightly, and both the ends are fixed with a tape and heated at 100° C. for 40 minutes. After cooling to room temperature, the filament is cut into a piece of 85 mm which is then folded in two, and both the ends are connected with sewing thread and suspended from a bar of 4 mmΦ. A loading of 6.7 mg/dtex is fixed to the sample which is then maintained at 30° C. under 60% RH for 24 hours. The loading is removed, and the sample is left for 5 minutes and cut to give a 80-mm sample which is then measured for the bending (angle) of the filament. The bending is regarded as an indication of easiness of curling at low temperatures, and it is most preferable that the recovered filament is straight (180° C.)

(Curling Retention)

A filament in the state of a straw raincoat is wound around a 32 mmΦ pipe, then curled for 60 minutes at predetermined temperatures of 100 to 180° C. and aged at room temperature for 60 minutes, and the curled filament is suspended by fixing one end of the filament and measured for its initial length and a change in length with time over 7 days. This is regarded as an indicator of easiness of curling and retention of curling. The initial length is preferably shorter, and the filament is preferably the one capable of curling set at both lower and higher temperatures.

(Iron Setting)

This is an indicator of easiness of curling with a hair iron and retention of curling. Filaments are sandwiched softly with a hair iron at 180° C. and preheated 3 times. Fusion among the filaments, combing thereof, filament shrinkage and filament cutting are evaluated with the naked eye. Then, the preheated filaments are wound around the hair iron and kept for 10 seconds, and the iron is removed. Easiness of this removal (rod-out property) and the retention of curling after removal are evaluated with the naked eye.

(Limit Oxygen Index)

16 cm/0.25 g filaments are weighed, and their edges are gathered softly with a double-coated tape and then twisted with a twisting machine. When the filaments are sufficiently twisted, the sample is folded in two and then twisted. The edges are fixed with a cellophane tape to give a sample of 7 cm in length. The sample is pre-dried at 105° C. for 60 minutes and dried for 30 minutes or more in a desiccator. The dried sample is regulated at a predetermined oxygen concentration, and 40 seconds later, an upper part of the sample is ignited with a lighter squeezed to 8 to 12 mm. After ignition, the lighter is removed, and the concentration of oxygen when 5 cm or more area of the sample is burned or the sample is burned for 3 minutes or more is measured. This test is carried out 3 times under the same conditions, to determine the limit oxygen index.

(Dripping)

100 filaments having a finiteness of about 50 dtex are bundled together, and their one end is clipped with a clamp and fixed to a stand from which the filaments are suspended vertically. By approaching 20 mm flame to the fixed filaments, a part (100 mm in length) of the filaments is burned during which the number of drips is counted; ○ is given when the number of drips is 5 or less, Δ is given when the number is 6 to 10, and X is given when the number is 11 or more.

(Gloss)

Tofilaments having a length of 30 cm and a total finiteness of 100,000 dtex are evaluated with the naked eye under sunlight.

◎: Gloss is regulated at a level equal to human hair.

○: Gloss is suitably regulated.

Δ: Gloss is slightly high or slightly low.

X: Gloss is too high or too low.

Synthesis Example A-1 to A-3

A pressure vessel equipped with a nitrogen-introducing tube, a solvent distillation tube, a pressure gauge and an internal temperature-measuring site was charged with the monomers and catalyst shown in Table 1, and the mixture was heated to 150° C. under stirring in a nitrogen atmosphere. The reaction temperature was increased to 190° C. over 30 minutes and stirred for 1 hour, and the depolymerization reaction was allowed to proceed. The reaction temperature increased to 230° C. over 30 minutes at ordinary pressures, and an excess of ethylene glycol was distilled away and further distilled away under weakly reduced pressure. Then, the reaction temperature was increased to 280° C. over 30 minutes, and the internal pressure was reduced over 1 hour to $1.33\times10^2$ Pa (1 Torr) or less, and the reaction mixture was stirred until the intrinsic viscosity of the melt became 0.80, to give the copolymerized polyesters (A-1) to (A-3).

TABLE 1

| | Synthesis Examples | | |
|---|---|---|---|
| | A-1 | A-2 | A-3 |
| Polyethylene terephthalate*1 (g) | 2880 | 2880 | 2880 |
| Dihydroxyethyl 5-sodium sulfoisophthalate (g) | 108 | | |
| 2,2-Bis(4-(2-hydroxy)phenyl)propane (g) | | 246 | |
| 1,4-Dicyclohexane dimethanol (g) | | | 102 |
| Ethylene glycol (g) | 1000 | 1000 | 1000 |
| Phenol-based antioxidant*2 (g) | 5.8 | 5.8 | 5.8 |
| Germanium dioxide (g) | 0.9 | 1.2 | 1.2 |

*1Velpet EFG-10, IV = 0.60, manufactured by Kanebo Gosen Co., Ltd.
*2Adekastab AO-60 manufactured by Asahi Denka Kogyo K.K.

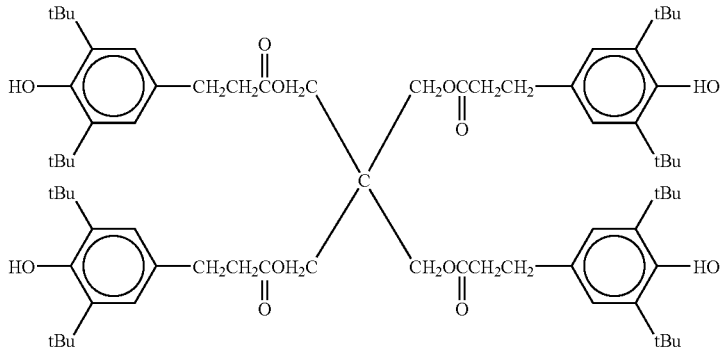

Examples 1 to 14

Polyester, polyarylate and a phosphite-based antioxidant dried at a water content of 100 ppm or less were mixed in the compounding ratio shown in Table 2, and 1.5 parts by weight of coloring polyester pellet PESM6100 BLACK (carbon black content of 30% manufactured by Dainichiseika Color & Chemicals Mgf. Co., Ltd.) was added to and dry-blended with 100 parts by weight of the above mixture, then fed to an extruder, melt-kneaded at 300° C., formed into pellets and dried at a water content of 100 ppm or less. Then, the molten polymer was discharged at 300° C. through a spinneret having a nozzle having a round section of 0.5 mm in diameter, cooled in a water bath at a water temperature of 50° C. placed in a position 30 cm below the spinneret and wound at a rate of 100 m/min. to give a non-stretched filament. The resulting non-stretched filament was stretched to give a 4-fold stretched filament in a hot water bath at 90° C., then wound at a rate of 100 m/min. on a heat roll heated at 200° C. and heat-treated to give polyester-based fiber (multifilament) having a single fiber finiteness of about 50 dtex.

The resulting fiber was used to evaluate strength and elongation, heat shrinkage, the average size/number of surface protrusions, gloss, cold setting, curling retention and iron setting.

The results are shown in Tables 3 and 4.

TABLE 2

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Polyethylene terephthalate*3 (parts) | 85 | 88 | 85 | 75 | 85 | 85 | 85 | 85 | 85 | | | | | |
| Copolymerized polyester (A-1) (parts) | | | | | | | | | | 90 | 85 | 75 | | |
| Copolymerized polyester (A-2) (parts) | | | | | | | | | | | | | 85 | |
| Copolymerized polyester (A-3) (parts) | | | | | | | | | | | | | | 85 |
| Polyarylate*4 (parts) | 15 | 12 | 15 | 25 | 15 | 15 | 15 | 15 | 15 | 10 | 15 | 25 | 15 | 15 |
| Phosphite-based antioxidant*5 (parts) | 1 | | | | | | | | | | | | | |
| Phosphite-based antioxidant*6 (parts) | | 1 | 1 | 1 | 0.5 | 3 | | | | 1 | 1 | 1 | 1 | 1 |
| Phosphite-based antioxidant*7 (parts) | | | | | | | 1 | | | | | | | |
| Phosphite-based antioxidant*8 (parts) | | | | | | | | 1 | | | | | | |
| Tris(2,4-di(t-butyl)phenyl) phosphite (parts) | | | | | | | | | 1 | | | | | |

*3: Velpet EFG-85A, IV = 0.85, manufactured by Kanebo Gosen Co., Ltd.

*4: U-100, IV = 0.60, manufactured by Unitika Ltd.

*5: Adekastab PEP-24G manufactured by Asahi Denka Kogyo K.K.

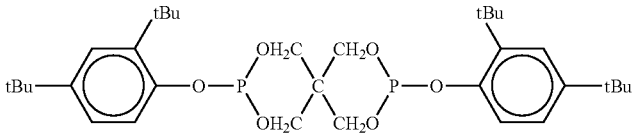

TABLE 2-continued

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |

*6: Adekastab PEP-36 manufactured by Asahi Denka Kogyo K.K.

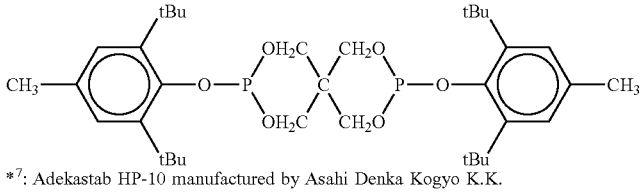

*7: Adekastab HP-10 manufactured by Asahi Denka Kogyo K.K.

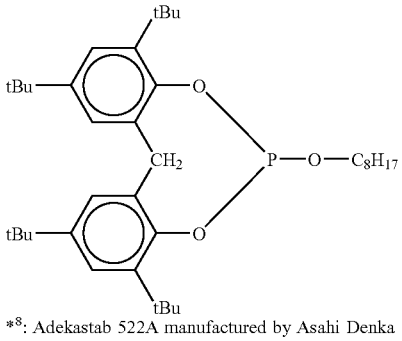

*8: Adekastab 522A manufactured by Asahi Denka Kogyo K.K.

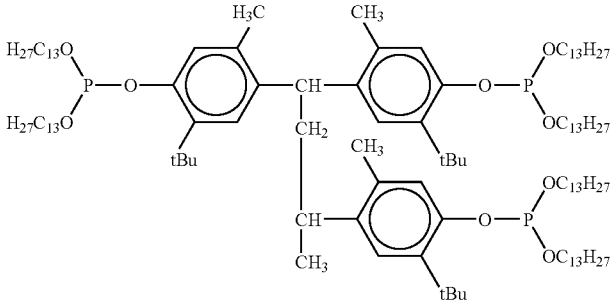

Comparative Example 1

1.5 parts by weight of coloring polyester pellet PESM6100 BLACK (carbon black content of 30% manufactured by Dainichiseika Color & Chemicals Mgf. Co., Ltd.) was added to and dry-blended with 100 parts by weight of polyethylene terephthalate (Velpet EFG-10 manufactured by Kanebo Gosen Co., Ltd.) dried at a water content of 100 ppm or less, and its molten polymer was discharged through a spinneret having a nozzle having a round section of 0.5 mm in diameter, cooled in a water bath at a water temperature of 30° C. placed in a position 30 cm below the spinneret and wound at a rate of 100 m/min. to give a non-stretched filament. The resulting non-stretched filament was stretched to give a 4-fold stretched filament in a hot water bath at 80° C., then wound at a rate of 100 m/min. on a heat roll heated at 200° C. and heat-treated to give polyester-based fiber-(multifilament) having a single fiber finiteness of about 48 dtex.

The resulting fiber was used to evaluate strength and elongation, heat shrinkage, the average size/number of surface protrusions, gloss, cold setting, curling retention and iron setting.

The results are shown in Table 4.

Comparative Example 2

1 part by weight of titanium oxide was added to 100 parts by weight of polyethylene terephthalate (Velpet EFG-10 manufactured by Kanebo Gosen Co., Ltd.), and heat-shrinkable polyester-based fiber (multifilament) having a single fiber finiteness of 50 dtex was obtained in the same manner as in Comparative Example 1.

The resulting fiber was used to evaluate strength and elongation, heat shrinkage, the average size/number of surface protrusions, gloss, cold setting, curling retention and iron setting.

The results are shown in Table 4.

Comparative Example 3

3 parts by weight of flocculating silicon oxide was added to 100 parts by weight of polyethylene terephthalate (Velpet EFG-10 manufactured by Kanebo Gosen Co., Ltd.), and a filament having a single fiber finiteness of 55 dtex was obtained in the same manner as in Comparative Example 1. The resulting filament was dipped for 30 minutes in 5% aqueous sodium hydroxide heated at 98° C., and then treated such that the loss in weight reached 8%, to give polyester-based fiber (multifilament) having a single fiber finiteness of about 48 dtex.

The resulting fiber was used to evaluate strength and elongation, heat shrinkage, the average size/number of surface protrusions, gloss, cold setting, curling retention and iron setting.

The results are shown in Table 4.

TABLE 3

| | Examples | | | | | | | | | |
|---|---|---|---|---|---|---|---|---|---|---|
| | 1 | 2 | 3 | 4 | 5 | 6 | 7 | 8 | 9 | 10 |
| Finiteness (dtex) | 52 | 52 | 51 | 50 | 53 | 50 | 49 | 52 | 51 | 53 |
| Strength (cN/dtex) | 2.4 | 2.9 | 2.3 | 2.0 | 2.4 | 2.1 | 2.6 | 2.5 | 2.7 | 2.4 |
| Elongation (%) | 48 | 57 | 46 | 38 | 48 | 52 | 47 | 44 | 48 | 55 |
| Degree of shrinkage at 180° C. (%) | 3 | 4 | 3 | 3 | 4 | 3 | 4 | 3 | 3 | 3 |
| Average size/number of surface protrusions | | | | | | | | | | |
| Major axis (μm) | 1.7 | 1.5 | 1.5 | 1.8 | 2.2 | 1.0 | 1.9 | 1.8 | 2.0 | 3.0 |
| Minor axis (μm) | 0.5 | 0.4 | 0.4 | 0.6 | 0.9 | 0.3 | 0.6 | 0.5 | 0.6 | 0.9 |
| Height (μm) | 0.4 | 0.3 | 0.3 | 0.4 | 0.6 | 0.2 | 0.4 | 0.4 | 0.5 | 0.7 |
| Number of protrusions/100 $\mu m^2$ | 18 | 14 | 20 | 24 | 16 | 26 | 18 | 17 | 12 | 10 |
| Gloss | ○ | ○ | ○ | Δ | ○ | Δ | ○ | ○ | ○ | ○ |
| Cold setting | 121 | 113 | 122 | 127 | 118 | 114 | 119 | 119 | 118 | 107 |
| Curling retention (setting at 100° C.) | | | | | | | | | | |
| Initial length (cm) | 15.2 | 15.0 | 14.1 | 13.8 | 15.5 | 13.2 | 15.0 | 15.1 | 15.7 | 16.8 |
| After 7 days (cm) | 18.0 | 17.7 | 16.4 | 16.0 | 18.2 | 15.2 | 17.6 | 17.8 | 18.5 | 20.0 |
| Elongation (%) | 18.5 | 17.9 | 16.5 | 15.7 | 17.2 | 14.9 | 17.0 | 17.7 | 17.8 | 18.9 |
| Iron setting (setting at 180° C.) | | | | | | | | | | |
| Fusion | ○ | ○ | ○ | ○ | ○ | ○ | ○ | ○ | ○ | ○ |
| Shrinkage/filament cutting | ○ | ○ | ○ | ○ | ○ | ○ | ○ | ○ | ○ | ○ |
| Rod-out property | ○ | ○ | ○ | ○ | ○ | ○ | ○ | ○ | ○ | ○ |
| Curling retention | ○ | Δ | ○ | ○ | ○ | ○ | ○ | ○ | ○ | Δ |

TABLE 4

| | Examples | | | | Comparative Examples | | |
|---|---|---|---|---|---|---|---|
| | 11 | 12 | 13 | 14 | 1 | 2 | 3 |
| Finiteness (dtex) | 53 | 52 | 51 | 54 | 52 | 50 | 48 |
| Strength (cN/dtex) | 2.1 | 1.9 | 2.3 | 2.2 | 2.2 | 2.1 | 2.6 |
| Elongation (%) | 53 | 50 | 72 | 76 | 81 | 77 | 62 |
| Degree of shrinkage at 180° C. (%) | 3 | 4 | 7 | 6 | 6 | 6 | 4 |
| Average size/number of surface protrusions | | | | | | | |
| Major axis (μm) | 3.4 | 4.0 | 2.8 | 3.2 | — | 0.2 | 1.8 |
| Minor axis (μm) | 1.1 | 1.3 | 0.8 | 1.0 | — | 0.2 | 1.1 |
| Height (μm) | 0.9 | 1.2 | 0.7 | 0.8 | — | 0.05 | 0.6 |
| Number of protrusions/100 $\mu m^2$ | 7 | 5 | 9 | 10 | — | 4 | 2 |
| Gloss | ○ | ○ | ○ | ○ | X | X | Δ |
| Cold setting | 112 | 116 | 113 | 110 | 114 | 113 | 109 |
| Curling retention (setting at 100° C.) | | | | | | | |
| Initial length (cm) | 16.2 | 15.4 | 13.8 | 14.2 | 16.6 | 16.5 | 17.5 |
| After 7 days (cm) | 19.0 | 18.0 | 15.7 | 16.1 | 20.0 | 20.1 | 21.5 |
| Elongation (%) | 17.5 | 16.9 | 13.5 | 13.7 | 20.2 | 21.9 | 23.0 |
| Iron setting (setting at 180° C.) | | | | | | | |
| Fusion | ○ | ○ | ○ | ○ | ○ | ○ | ○ |
| Shrinkage/filament cutting | ○ | ○ | ○ | ○ | ○ | ○ | ○ |
| Rod-out property | ○ | ○ | ○ | ○ | Δ | Δ | Δ |
| Curling retention | ○ | ○ | ○ | ○ | Δ | Δ | Δ |

Figure 2:
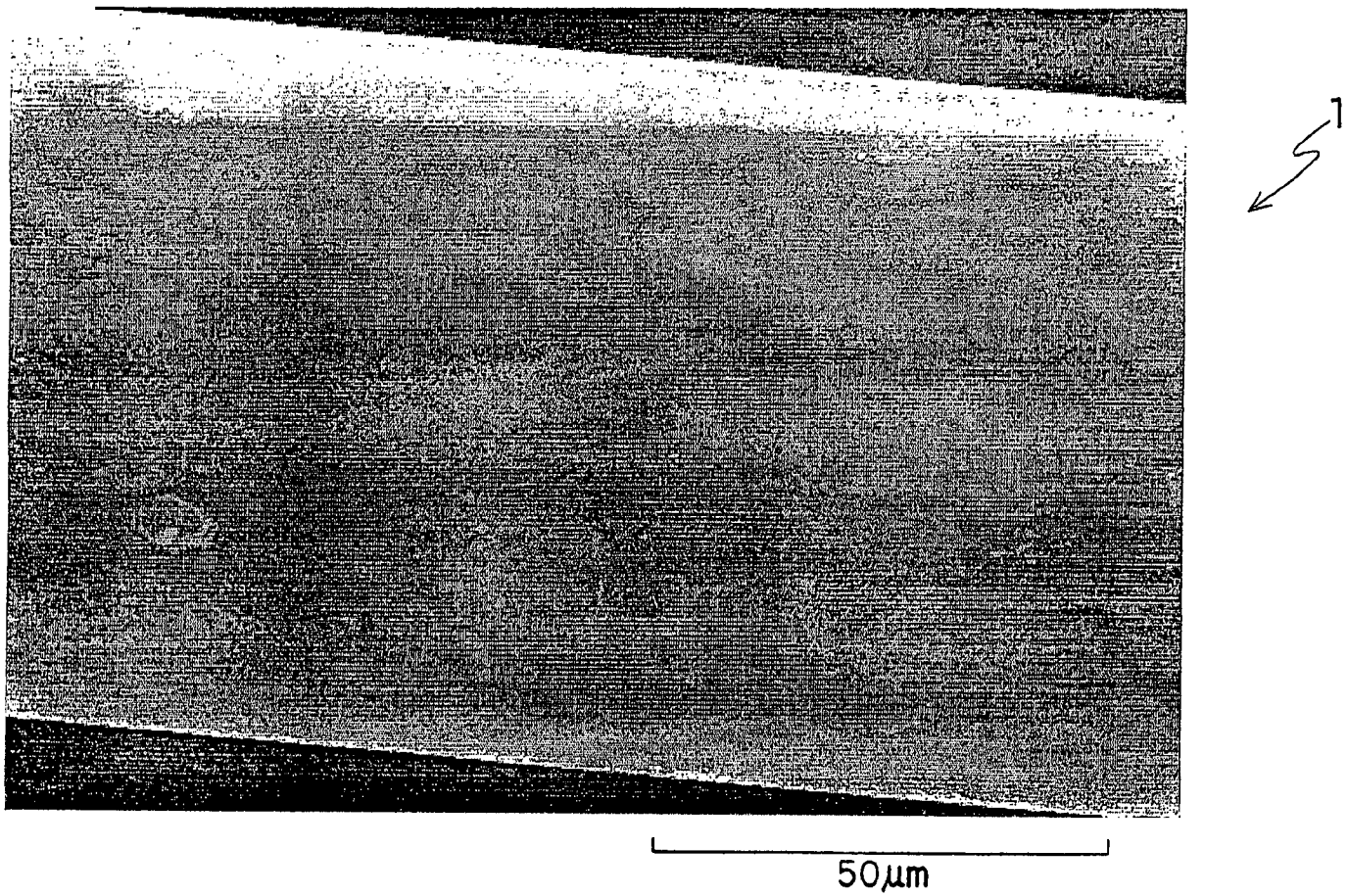
FIG. 2 is a photograph showing the surface of polyester-based fiber comprising the polyester (A) free of the polyarylate (B) and the phosphite compound (C).

FIG. 1 is a photograph showing the surface of the polyester-based fiber in Example 3. In FIG. 1, protrusion 2 is present on the surface of the polyester-based fiber 1. FIG. 2 is a photograph showing the surface of the polyester-based fiber in Comparative Example 6. In FIG. 2, there is no protrusion on the surface of the polyester-based fiber 1.

Examples 15 to 26

A phosphorus based flame retardant and a phosphite compound were mixed, in a ratio shown in Table 5, with 100 parts by weight of a mixture of polyester and polyarylate dried at a water content of 100 ppm or less, and 1.5 parts of coloring polyester pellet PESM6100 BLACK (carbon black content of 30% manufactured by Dainichiseika Color & Chemicals Mgf. Co., Ltd.; the polyester is contained in the component (A)) was dry-blended therewith, then fed to an extruder, melt-kneaded at 300° C., formed into pellets and dried at a water content of 100 μm or less. Then, its molten polymer was discharged at 300° C. through a spinneret having a nozzle having a round section of 0.5 mm in diameter in a melt-spinning machine, cooled in a water bath at a water temperature of 50° C. placed in a position 30 cm below the spinneret and wound at a rate of 100 m/min. to give anon-stretched filament. The resulting non-stretched filament was stretched to give a 4-fold stretched filament in a hot water bath at 90° C., then wound at a rate of 100 m/min. on a heat roll heated at 200° C. and heat-treated to give polyester-based fiber (multifilament) having a single fiber finiteness of about 50 dtex.

The resulting fiber was used to evaluate strength and elongation, heat shrinkage, limit oxygen index, dripping, the average size/number of surface protrusions, gloss, cold setting, curling retention and iron setting.

The results are shown in Tables 6 and 7.

TABLE 5

| | Examples | | | | | | | | | | | |
|---|---|---|---|---|---|---|---|---|---|---|---|---|
| | 15 | 16 | 17 | 18 | 19 | 20 | 21 | 22 | 23 | 24 | 25 | 26 |
| Polyethylene terephthalate*3 (parts) | 88 | 85 | 75 | 85 | 85 | 85 | 85 | 85 | 85 | 85 | 85 | 85 |
| Polyarylate*4 (parts) | 12 | 15 | 25 | 15 | 15 | 15 | 15 | 15 | 15 | 15 | 15 | 15 |
| 1,3-Phenylenebis(dixylenyl phosphate) (parts) | 10 | 10 | 5 | 10 | 10 | | | | | 10 | 10 | 10 |
| 4,4'-Biphenylbis(dixylenyl phosphate) (parts) | | | | | | 10 | | | | | | |
| Phosphorus based flame retardant*9 (parts) | | | | | | | 10 | 10 | 5 | | | |
| Phosphite-based antioxidant*5 (parts) | 1 | 1 | 1 | 0.5 | 3 | 1 | 1 | 3 | 3 | | | |
| Phosphite-based antioxidant*6 (parts) | | | | | | | | | | 1 | | |
| Phosphite-based antioxidant*7 (parts) | | | | | | | | | | | 1 | |
| Phosphite-based antioxidant*8 (parts) | | | | | | | | | | | | 1 |

*3: Velpet EFG-85A, IV = 0.85, manufactured by Kanebo Gosen Co., Ltd.

*4: U-100, IV = 0.60, manufactured by Unitika Ltd.

*9: Condensed phosphate compound

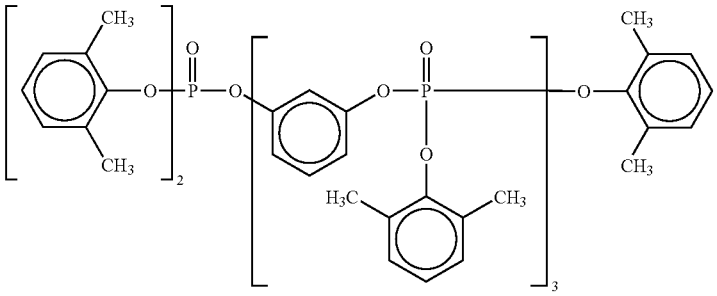

*5: Adekastab PEP-24G manufactured by Asahi Denka Kogyo K.K.

*6: Adekastab PEP-36 manufactured by Asahi Denka Kogyo K.K.

*7: Adekastab HP-10 manufactured by Asahi Denka Kogyo K.K.

*8: Adekastab 522A manufactured by Asahi Denka Kogyo K.K.

Comparative Example 4

10 parts of triphenyl phosphate and 1.5 parts of coloring polyester pellet PESM6100 BLACK (carbon black content of 30% manufactured by Dainichiseika Color & Chemicals Mgf. Co., Ltd.) were added to and dry-blended with 100 parts of polyethylene terephthalate (Velpet EFG-10 manufactured by Kanebo Gosen Co., Ltd.) dried at a water content of 100 ppm or less, and its molten polymer was discharged through a spinneret having a nozzle having a round section of 0.5 mm in diameter, cooled in a water bath at a water temperature of 30° C. placed in a position 30 cm below the spinneret and wound at a rate of 100 m/min. to give a non-stretched filament. The resulting non-stretched filament was stretched to give a 4-fold stretched filament in a hot water bath at 80° C., then wound at a rate of 100 m/min. on a heat roll heated at 200° C. and heat-treated to give polyester-based fiber (multifilament) having a single fiber finiteness of about 52 dtex.

The resulting fiber was used to evaluate strength and elongation, heat shrinkage, limit oxygen index, dripping, the average size/number of surface protrusions, gloss, cold setting, curling retention and iron setting.

The results are shown in Table 7.

Comparative Example 5

10 parts of 1,3-phenylene-bis(dixylenyl phosphate) and 1.5 parts of coloring polyester pellet PESM6100 BLACK (carbon black content of 30% manufactured by Dainichiseika Color & Chemicals Mgf. Co., Ltd.) were added to 100 parts of polyethylene terephthalate (Velpet EFG-10 manufactured by Kanebo Gosen Co., Ltd.) dried at a water content of 100 ppm or less, and heat-shrinkable polyester-based fiber (multifilament) having a single fiber finiteness of 50 dtex was obtained in the same manner as in Comparative Example 4.

The resulting fiber was used to evaluate strength and elongation, heat shrinkage, limit oxygen index, dripping, the average size/number of surface protrusions, gloss, cold setting, curling retention and iron setting.

The results are shown in Table 7.

Comparative Example 6

10 parts of 1,3-phenylene-bis(dixylenyl phosphate), 1 part of titanium oxide and 1.5 parts of coloring polyester pellet PESM6100 BLACK (carbon black content of 30% manufactured by Dainichiseika Color & Chemicals Mgf. Co., Ltd.) were added to 100 parts of polyethylene terephthalate (Velpet EFG-10 manufactured by Kanebo Gosen Co., Ltd.), and heat-shrinkable polyester-based fiber (multifilament) having a single fiber finiteness of 48 dtex was obtained in the same manner as in Comparative Example 4.

The resulting fiber was used to evaluate strength and elongation, heat shrinkage, limit oxygen index, dripping, the average size/number of surface protrusions, gloss, cold setting, curling retention and iron setting.

The results are shown in Table 7.

TABLE 6

| | Examples | | | | | | | | |
|---|---|---|---|---|---|---|---|---|---|
| | 15 | 16 | 17 | 18 | 19 | 20 | 21 | 22 | 23 |
| Finiteness (dtex) | 49 | 52 | 54 | 50 | 51 | 53 | 48 | 52 | 52 |
| Strength (cN/dtex) | 2.1 | 1.9 | 1.7 | 2.0 | 1.8 | 2.1 | 2.2 | 2.0 | 2.5 |
| Elongation (%) | 45 | 41 | 36 | 38 | 41 | 46 | 39 | 44 | 48 |
| Degree of shrinkage at 180° C. (%) | 4 | 3 | 3 | 3 | 4 | 4 | 3 | 3 | 4 |
| Limit oxygen index | 25.5 | 26.5 | 26.0 | 25.5 | 27.0 | 26.0 | 27.0 | 27.5 | 26.0 |
| Dripping | Δ | ○ | ○ | ○ | ○ | ○ | ○ | ○ | ○ |
| Average size/number of surface protrusions | | | | | | | | | |
| Major axis (μm) | 5.5 | 5.9 | 6.1 | 12.3 | 3.6 | 6.0 | 5.7 | 3.5 | 2.4 |
| Minor axis (μm) | 3.2 | 3.4 | 3.6 | 7.4 | 2.6 | 3.2 | 3.3 | 2.4 | 1.4 |
| Height (μm) | 1.3 | 1.7 | 1.6 | 1.7 | 1.2 | 1.5 | 1.8 | 1.3 | 0.8 |
| Number of protrusions/100 $\mu m^2$ | 2 | 3 | 5 | 1 | 4 | 3 | 3 | 4 | 8 |
| Gloss | ◎ | ○ | Δ | Δ | ○ | ○ | ○ | ○ | ◎ |
| Cold setting | 117 | 120 | 125 | 119 | 124 | 116 | 120 | 122 | 125 |
| Curling retention (setting at 100° C.) | | | | | | | | | |
| Initial length (cm) | 16.2 | 16.0 | 15.6 | 16.8 | 15.5 | 16.5 | 16.0 | 15.7 | 15.5 |
| After 7 days (cm) | 19.1 | 18.7 | 18.1 | 19.7 | 18.0 | 19.3 | 18.6 | 18.2 | 18.0 |
| Elongation (%) | 18.0 | 17.1 | 16.2 | 17.4 | 16.2 | 17.0 | 16.4 | 15.7 | 16.0 |
| Iron setting (setting at 180° C.) | | | | | | | | | |
| Fusion | ○ | ○ | ○ | ○ | ○ | ○ | ○ | ○ | ○ |
| Shrinkage/filament cutting | ○ | ○ | ○ | ○ | ○ | ○ | ○ | ○ | ○ |
| Rod-out property | Δ | ○ | ○ | ○ | ○ | ○ | ○ | ○ | ○ |
| Curling retention | Δ | ○ | ○ | ○ | ○ | ○ | ○ | ○ | ○ |

TABLE 7

| | Examples | | | Comparative Examples | | |
|---|---|---|---|---|---|---|
| | 24 | 25 | 26 | 4 | 5 | 6 |
| Finiteness (dtex) | 50 | 49 | 53 | 52 | 50 | 48 |
| Strength (cN/dtex) | 2.0 | 1.9 | 2.0 | 2.2 | 2.1 | 2.6 |
| Elongation (%) | 45 | 43 | 40 | 81 | 77 | 63 |
| Degree of shrinkage at 180° C. (%) | 3 | 4 | 4 | 7 | 5 | 5 |
| Limit oxygen index | 26.0 | 26.0 | 26.0 | 25.0 | 26.0 | 26.0 |
| Dripping | ○ | ○ | ○ | X | X | X |
| Average size/number of surface protrusions | | | | | | |
| Major axis (μm) | 7.2 | 8.6 | 8.0 | — | — | 0.2 |
| Minor axis (μm) | 5.0 | 6.0 | 5.7 | — | — | 0.2 |
| Height (μm) | 1.8 | 1.8 | 1.9 | — | — | 0.05 |
| Number of protrusions/100 $\mu m^2$ | 3 | 2 | 2 | — | — | 4 |
| Gloss | ○ | ○ | ○ | X | X | X |
| Cold setting | 115 | 116 | 118 | 101 | 105 | 107 |
| Curling retention (setting at 100° C.) | | | | | | |
| Initial length (cm) | 16.7 | 16.8 | 16.4 | 17.9 | 17.5 | 17.4 |
| After 7 days (cm) | 19.6 | 19.7 | 19.2 | 22.4 | 21.5 | 22.2 |
| Elongation (%) | 17.5 | 17.5 | 17.3 | 25.2 | 22.9 | 22.0 |
| Iron setting (setting at 180° C.) | | | | | | |
| Fusion | ○ | ○ | ○ | X | Δ | ○ |
| Shrinkage/filament cutting | ○ | ○ | ○ | ○ | ○ | ○ |
| Rod-out property | ○ | ○ | ○ | Δ | Δ | Δ |
| Curling retention | ○ | ○ | ○ | Δ | Δ | Δ |

Figure 3:
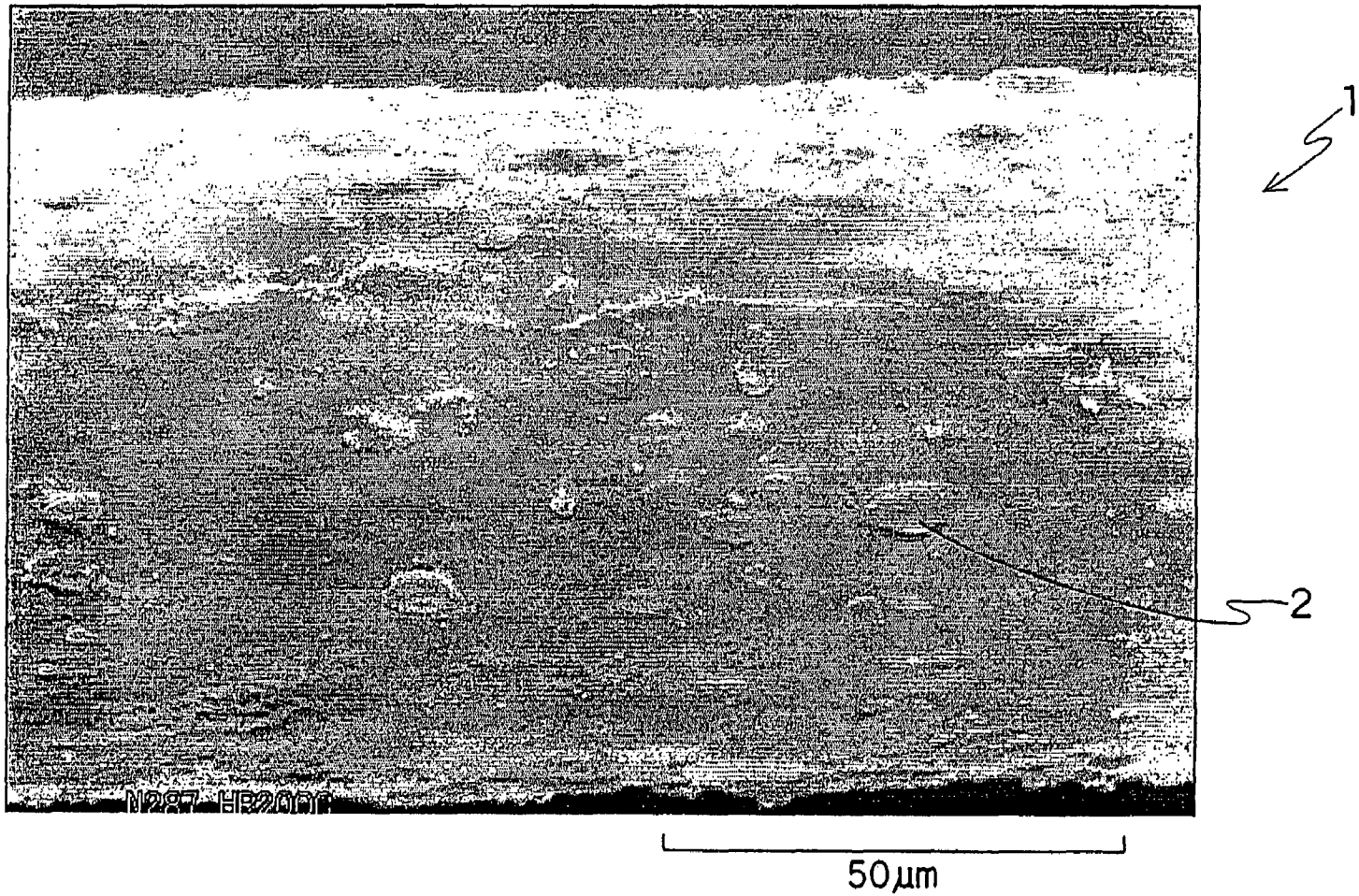
FIG. 3 is a photograph showing the surface of polyester-based fiber consisting of a composition comprising the polyester (A), the polyarylate (B), the phosphite compound (C) and the phosphorus based flame retardant (D).

FIG. 3 is a photograph showing the surface of the polyester-based fiber in Example 16. In FIG. 3, protrusion 2 is present on the surface of the polyester-based fiber 1.

Synthesis Example A-4 to A-7

A pressure vessel equipped with a nitrogen-introducing tube, a solvent distillation tube, a pressure gauge and an internal temperature measuring site was charged with the compounds and catalyst shown in Table 8, and the mixture was heated to 150° C. under stirring in a nitrogen atmosphere. The reaction temperature was increased to 230° C. over 3 hours and stirred for 1 hour, and an excess of ethylene glycol was distilled away. At ordinary pressures, the reaction temperature was increased to 280° C. for 1 hour, and the internal pressure was reduced over 1 hour to $1.33\times10^2$ Pa (1 Torr) or less, and the reaction mixture was stirred until the intrinsic viscosity of the melt became 0.80, to give the copolymerized polyesters (A-4) to (A-7).

TABLE 8

| | Synthesis Examples | | | |
|---|---|---|---|---|
| | A-4 | A-5 | A-6 | A-7 |
| Bis(2-hydroxyethyl) terephthalate (g) | 3556 | 3556 | 3556 | 3556 |
| Reactive phosphorus based flame retardant*10 (g) | 252 | | | |
| Reactive phosphorus based flame retardant*11 (g) | | 155 | | |
| Reactive phosphorus based flame retardant*12 (g) | | | 175 | |
| Reactive phosphorus based flame retardant*13 (g) | | | | 307 |
| Ethylene glycol (g) | 1000 | 1000 | 1000 | 1000 |
| Phenol-based antioxidant*2 (g) | 7 | 7 | 7 | 7 |
| Germanium dioxide (g) | 1.2 | 1.2 | 1.2 | 1.2 |

*10:

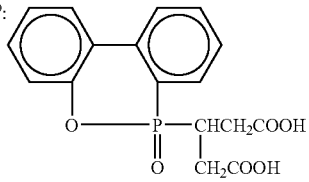

*11:

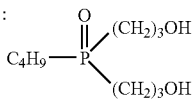

*12:

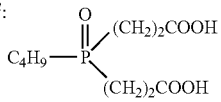

*13:

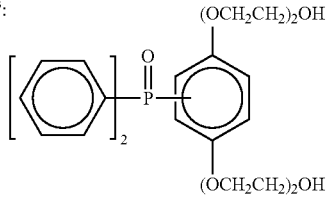

*2: Adekastab AO-60 manufactured by Asahi Denka Kogyo K.K.

Examples 27 to 36

Polyethylene terephthalates (A-4) to (A-7), polyarylate and a phosphite compound dried at a water content of 100 ppm or less were mixed in the compounding ratio shown in Table 9, and 1.5 parts by weight of coloring polyester pellet PESM6100 BLACK (carbon black content of 30% manufactured by Dainichiseika Color & Chemicals Mgf. Co., Ltd.) was added to and dry-blended with 100 parts of the above mixture, then fed to an extruder, melt-kneaded at 300° C., formed into pellets and dried at a water content of 100 ppm or less. Then, its molten polymer was discharged through a spinneret having a nozzle having a round section of 0.5 mm in diameter, cooled in a water bath at a water temperature of 50° C. placed in a position 30 mm below the spinneret and wound at a rate of 100 m/min. to give a non-stretched filament. The resulting non-stretched filament was stretched to give a 4-fold stretched filament in a hot water bath at 90° C., then wound at a rate of 100 m/min. on a heat roll heated at 200° C. and heat-treated to give polyester-based fiber (multifilament) having a single fiber finiteness of about 50 dtex.

The resulting fiber was used to evaluate strength and elongation, heat shrinkage, limit oxygen index, dripping, the average size/number of surface protrusions, gloss, cold setting, curling retention and iron setting.

The results are shown in Table 10.

TABLE 9

| | Examples | | | | | | | | | |
|---|---|---|---|---|---|---|---|---|---|---|
| | 27 | 28 | 29 | 30 | 31 | 32 | 33 | 34 | 35 | 36 |
| Polyester (A-4) (parts) | 85 | 75 | | | | | | | | |
| Polyester (A-5) (parts) | | | 85 | 85 | 85 | 75 | | | | |
| Polyester (A-6) (parts) | | | | | | | 85 | 85 | | |
| Polyester (A-7) (parts) | | | | | | | | | 85 | 85 |
| Polyarylate*4 (parts) | 15 | 25 | 15 | 15 | 15 | 25 | 15 | 15 | 15 | 15 |
| Phosphite-based antioxidant*5 (parts) | 1 | | | | | | | | | |
| Phosphite-based antioxidant*6 (parts) | | | 1 | | | 1 | 1 | | 1 | |
| Phosphite-based antioxidant*7 (parts) | | 1 | | 0.5 | | | | 0.5 | | |
| Phosphite-based antioxidant*8 (parts) | | | | | 2 | | | | | 2 |

*4U-100, IV = 0.60, manufactured by Unitika Ltd.
*5Adekastab PEP-24G manufactured by Asahi Denka Kogyo K.K.
*6Adekastab PEP-36 manufactured by Asahi Denka Kogyo K.K.
*7Adekastab HP-10 manufactured by Asahi Denka Kogyo K.K.
*8Adekastab 522A manufactured by Asahi Denka Kogyo K.K.

Comparative Example 7

1.5 parts of coloring polyester pellet PESM6100 BLACK (carbon black content of 30% manufactured by Dainichiseika Color & Chemicals Mgf. Co., Ltd.) were added to and dry-blended with 100 parts of polyethylene terephthalate (Velpet EFG-10 manufactured by Kanebo Gosen Co., Ltd.) dried at a water content of 100 ppm or less, and its molten polymer was discharged through a spinneret having a nozzle having a round section of 0.5 mm in diameter, cooled in a water bath at a water temperature of 30° C. placed in a position 25 cm below the spinneret and wound at a rate of 100 m/min. to give a non-stretched filament. The resulting non-stretched filament was stretched to give a 4-fold stretched filament in a hot water bath at 80° C., then wound at a rate of 100 m/min. on a heat roll heated at 200° C. and heat-treated to give polyester-based fiber (multifilament) having a single fiber finiteness of 52 dtex.

The resulting fiber was used to evaluate strength and elongation, heat shrinkage, limit oxygen index, dripping, the average size/number of surface protrusions, gloss, cold setting, curling retention and iron setting. The results are shown in Table 11.

TABLE 10

| | Examples | | | | | | | | | |
|---|---|---|---|---|---|---|---|---|---|---|
| | 27 | 28 | 29 | 30 | 31 | 32 | 33 | 34 | 35 | 36 |
| Finiteness (dtex) | 53 | 51 | 50 | 54 | 48 | 51 | 49 | 52 | 54 | 51 |
| Strength (cN/dtex) | 2.3 | 2.1 | 1.7 | 1.8 | 2.1 | 2.2 | 1.8 | 2.0 | 2.4 | 2.3 |
| Elongation (%) | 55 | 51 | 56 | 58 | 48 | 41 | 49 | 54 | 38 | 37 |
| Degree of shrinkage at 180° C. (%) | 4 | 4 | 5 | 5 | 5 | 4 | 6 | 6 | 4 | 5 |
| Limit oxygen index | 26.0 | 26.5 | 27.0 | 27.0 | 27.5 | 28.0 | 26.5 | 26.0 | 26.5 | 27.0 |
| Dripping | ○ | ○ | Δ | Δ | ○ | ○ | Δ | Δ | ○ | ○ |
| Average size/number of surface protrusions | | | | | | | | | | |
| Major axis (μm) | 3.0 | 3.2 | 2.5 | 3.6 | 2.0 | 2.7 | 2.4 | 3.4 | 3.1 | 2.4 |
| Minor axis (μm) | 1.5 | 1.7 | 1.2 | 1.4 | 0.9 | 1.4 | 1.2 | 1.4 | 1.4 | 0.9 |
| Height (μm) | 0.8 | 0.9 | 0.4 | 0.6 | 0.3 | 0.4 | 0.5 | 0.6 | 0.7 | 0.4 |
| Number of protrusions/100 $\mu m^2$ | 10 | 16 | 12 | 6 | 15 | 13 | 10 | 7 | 8 | 11 |
| Gloss | ○ | ○ | ○ | ○ | ○ | ○ | ○ | ○ | ○ | ○ |
| Cold setting | 112 | 114 | 115 | 117 | 119 | 120 | 116 | 114 | 119 | 120 |
| Curling retention (setting at 100° C.) | | | | | | | | | | |
| Initial length (cm) | 16.4 | 16.6 | 16.4 | 16.5 | 16.5 | 16.0 | 16.3 | 16.7 | 16.5 | 16.7 |
| After 7 days (cm) | 19.2 | 19.4 | 19.1 | 19.2 | 19.0 | 18.4 | 19.0 | 19.5 | 19.1 | 19.5 |
| Elongation (%) | 17.0 | 17.1 | 16.7 | 16.4 | 15.2 | 15.0 | 16.5 | 16.7 | 16.0 | 16.5 |
| Iron setting (setting at 180° C.) | | | | | | | | | | |
| Fusion | ○ | ○ | ○ | ○ | ○ | ○ | ○ | ○ | ○ | ○ |
| Shrinkage/filament cutting | ○ | ○ | ○ | ○ | ○ | ○ | ○ | ○ | ○ | ○ |
| Rod-out property | Δ | Δ | ○ | ○ | ○ | ○ | ○ | ○ | ○ | ○ |
| Curling retention | Δ | Δ | ○ | ○ | ○ | ○ | ○ | ○ | ○ | ○ |

Comparative Example 8

Polyester-based fiber (multifilament) having a single fiber finiteness of 48 dtex was prepared in the same manner as in Comparative Example 7 except that the polymer used was changed into polyethylene terephthalate (A-5).

The resulting fiber was used to evaluate strength and elongation, heat shrinkage, limit oxygen index, dripping, the average size/number of surface protrusions, gloss, cold setting, curling retention and iron setting. The results are shown in Table 11.

Comparative Example 9

Polyester-based fiber (multifilament) having a single fiber finiteness of 51 dtex was prepared in the same manner as in Comparative Example 7 except that the polymer used was changed into 85 parts of polyethylene terephthalate (Velpet EFG-10 manufactured by Kanebo Gosen Co., Ltd.) and 15 parts of polyarylate.

The resulting fiber was used to evaluate strength and elongation, heat shrinkage, limit oxygen index, dripping, the average size/number of surface protrusions, gloss, cold setting, curling retention and iron setting. The results are shown in Table 11.

TABLE 11

| | Comparative Examples | | |
|---|---|---|---|
| | 7 | 8 | 9 |
| Finiteness (dtex) | 52 | 48 | 51 |
| Strength (cN/dtex) | 2.6 | 2.0 | 2.2 |
| Elongation (%) | 74 | 82 | 42 |
| Shrinkage at 180° C. (%) | 6 | 8 | 5 |
| Limit oxygen index | 21.0 | 26.0 | 23.0 |
| Dripping | X | X | ○ |
| Average size/number of surface protrusions | | | |
| Major axis (μm) | — | — | — |
| Minor axis (μm) | — | — | — |
| Height (μm) | — | — | — |
| Number of protrusions/100 $\mu m^2$ | — | — | — |
| Gloss | X | X | ○ |

TABLE 11-continued

| | Comparative Examples | | |
|---|---|---|---|
| | 7 | 8 | 9 |
| Cold setting | 102 | 97 | 118 |
| Curling retention (setting at 100° C.) | | | |
| Initial length (cm) | 17.8 | 18.6 | 16.9 |
| After 7 days (cm) | 22.1 | 23.4 | 19.8 |
| Elongation (%) | 24.2 | 25.9 | 17.0 |
| Iron setting (setting at 180° C.) | | | |
| Fusion | ○ | Δ | Δ |
| Shrinkage/filament cutting | ○ | ○ | Δ |
| Rod-out property | ○ | Δ | Δ |
| curling retention | ○ | Δ | ○ |

Figure 4:
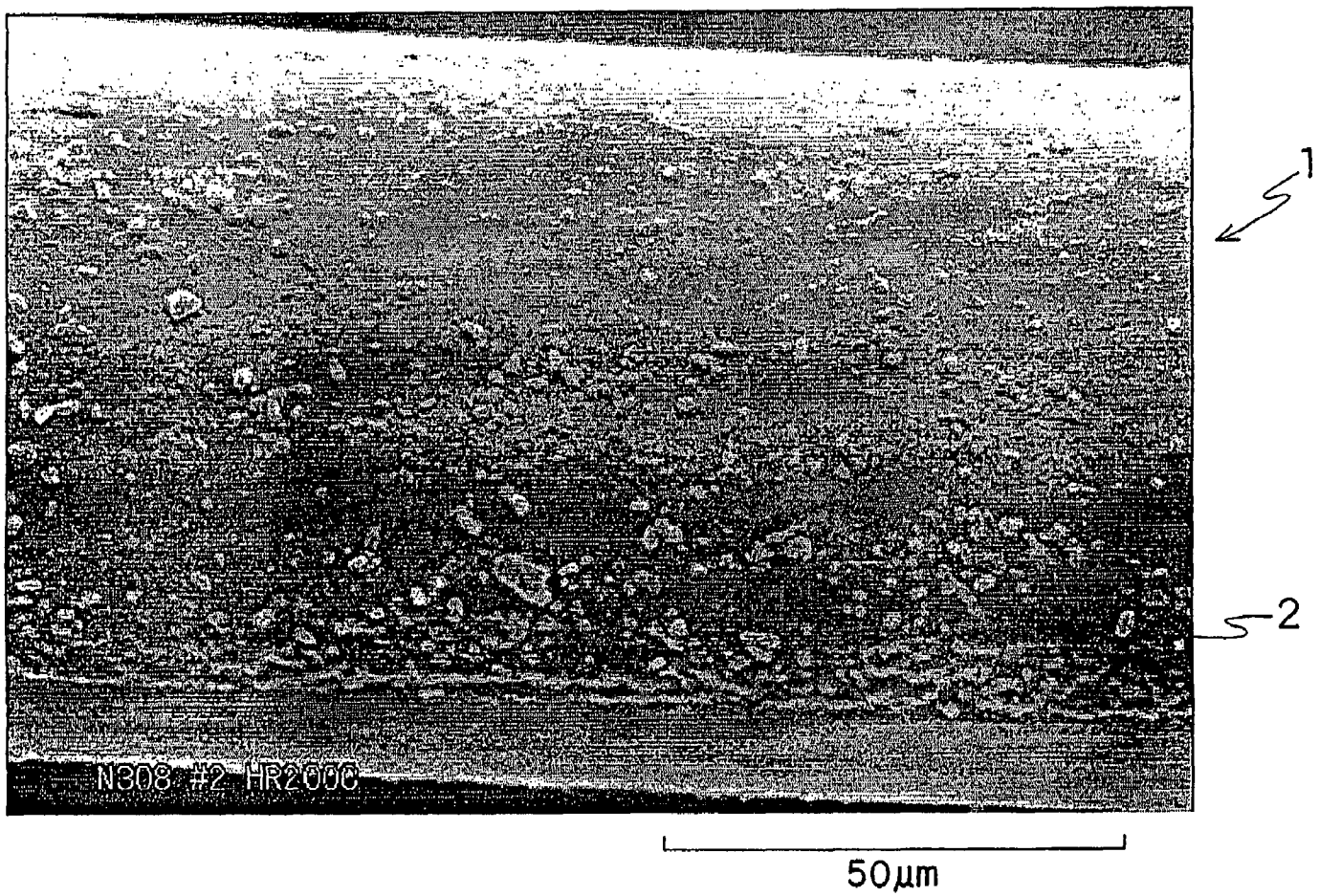
FIG. 4 is a photograph showing the surface of polyester-based fiber consisting of a composition comprising the copolymerized thermoplastic polyester (A) comprising a reactive phosphorus based flame retardant copolymerized therein, the polyarylate (B) and the phosphite compound (C).

FIG. 4 is a photograph showing the surface of the polyester-based fiber in Example 29. In FIG. 4, protrusion 2 is present on the surface of the polyester-based fiber 1.

Examples 37 to 42

Polyethylene terephthalate, polyarylate, a phosphorus based flame retardant and a phosphite compound dried at a water content of 100 ppm or less were mixed in the compounding ratio shown in Table 12, and the mixture was melt-kneaded once at a Q/R value of 0.5 by rotation in the same direction at a cylinder temperature set at 250 to 270° C. with a twin screw extruder TEX44SS (The Japan Steel Works, Ltd.) having an L/D value of 38, to give a composition. The resulting composition was dried at a water content of 100 ppm or less, and its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

TABLE 12

| | Examples | | | | | |
|---|---|---|---|---|---|---|
| | 37 | 38 | 39 | 40 | 41 | 42 |
| Polyethylene terephthalate*3 (parts) | 85 | 85 | 75 | 75 | 85 | 85 |
| Polyarylate*4 (parts) | 15 | | | | 15 | 15 |
| Polyarylate*14 (parts) | | 15 | 25 | 25 | | |
| Phosphorus based flame retardant*15 (parts) | 10 | 10 | 10 | 5 | 10 | |
| Phosphorus based flame retardant*9 (parts) | | | | | | 10 |
| Phosphite-based antioxidant*6 (parts) | 1 | 1 | 1 | 1 | | |
| Phosphite-based antioxidant*8 (parts) | | | | | 2 | 2 |

*3: Velpet EFG-85A, IV = 0.85, manufactured by Kanebo Gosen Co., Ltd.

*4: U-100, IV = 0.60, manufactured by Unitika Ltd.

*14: Powdered U-100, IV = 0.60, manufactured by Unitika Ltd.

*15: PX-200 manufactured by Daihachi Kagaku Co., Ltd.

TABLE 12-continued

| | Examples | | | | | |
|---|---|---|---|---|---|---|
| | 37 | 38 | 39 | 40 | 41 | 42 |
| 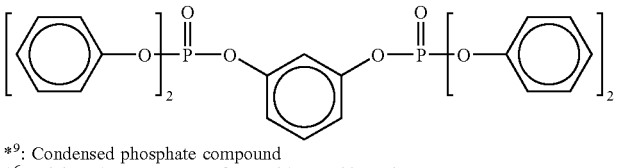 | | | | | | |

*9: Condensed phosphate compound
*6: Adekastab PEP-36 manufactured by Asahi Denka Kogyo K.K.
*8: Adekastab 522A manufactured by Asahi Denka Kogyo K.K.

The resulting composition and fiber were evaluated for the diameter/number of dispersed particles of the component (B), strength and elongation, heat shrinkage, limit oxygen index, dripping and iron setting. The results are shown in Table 13.

TABLE 13

| | Examples | | | | | |
|---|---|---|---|---|---|---|
| | 37 | 38 | 39 | 40 | 41 | 42 |
| Average diameter/number of dispersed particles of component (B) | | | | | | |
| Major axis (μm) | 2.0 | 1.6 | 2.4 | 1.7 | 1.7 | 1.4 |
| Minor axis (μm) | 1.4 | 1.0 | 1.7 | 1.3 | 1.2 | 0.9 |
| Number of protrusions/100 $\mu m^2$ | 6 | 8 | 6 | 8 | 8 | 9 |
| Finiteness (dtex) | 51 | 50 | 49 | 52 | 54 | 51 |
| Strength (cN/dtex) | 1.9 | 1.8 | 1.7 | 1.9 | 2.0 | 2.0 |
| Elongation (%) | 54 | 53 | 42 | 37 | 48 | 46 |
| Degree of shrinkage at 180° C. (%) | 3 | 3 | 4 | 3 | 4 | 3 |
| Limit oxygen index | 25.7 | 25.8 | 26.4 | 24.5 | 26.0 | 26.2 |
| Dripping | ○ | ○ | ○ | ○ | ○ | ○ |
| Iron setting (setting at 180° C.) | | | | | | |
| Fusion | ○ | ○ | ○ | ○ | ○ | ○ |
| Shrinkage/filament cutting | ○ | ○ | ○ | ○ | ○ | ○ |
| Rod-out property | ○ | ○ | ○ | ○ | ○ | ○ |
| Curling retention | ○ | ○ | ○ | ○ | ○ | ○ |

Figure 5:
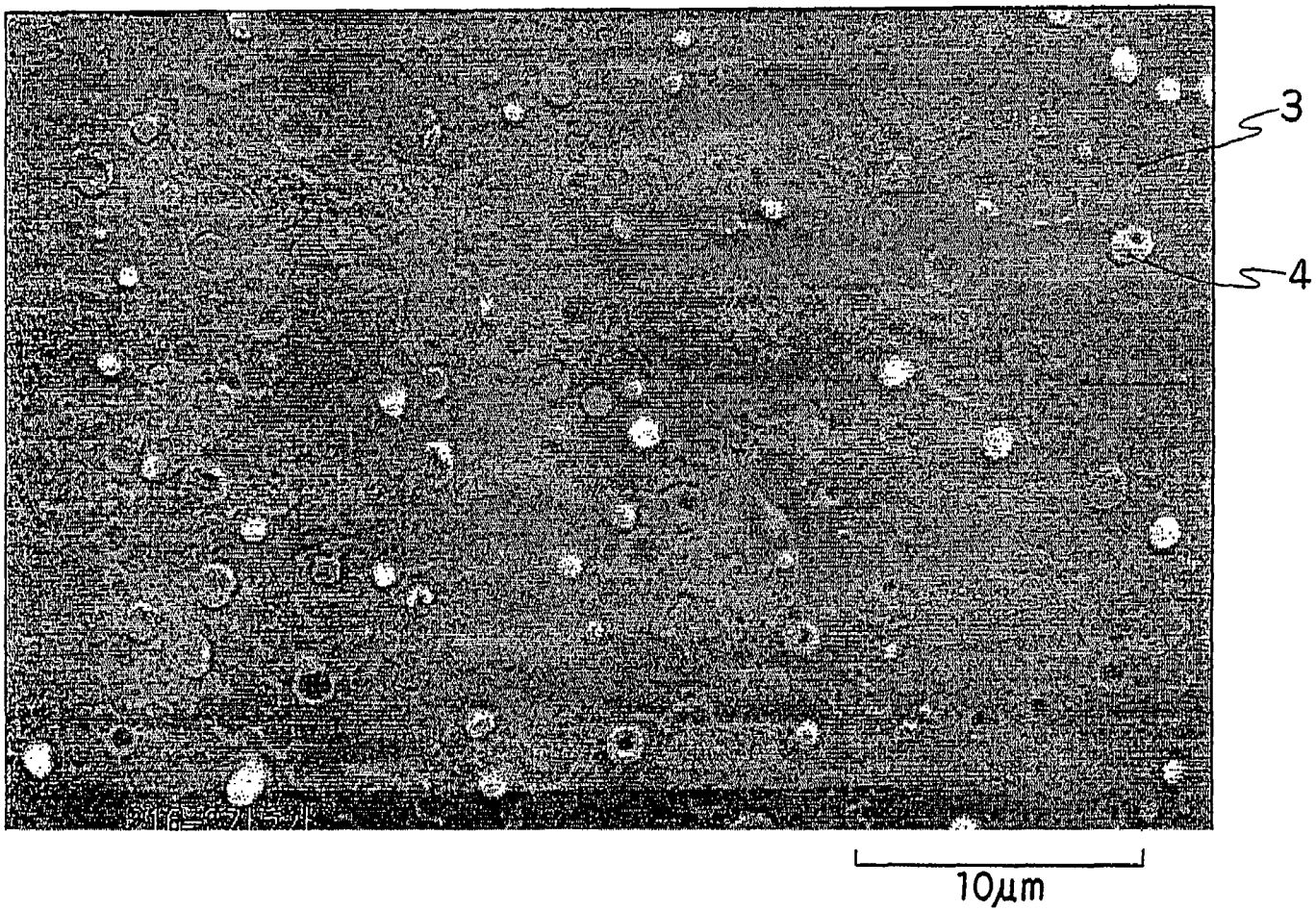
FIG. 5 is a photograph showing a section of a polyester-based resin pellet consisting of a composition comprising the polyester (A), the polyarylate (B), the phosphite compound (C) and the phosphorus based flame retardant (D).

FIG. 5 is a photograph showing a section of the polyester-based resin pellet in Example 37. In FIG. 5, the component (B) 4 is dispersed in the component (A) 3.

Examples 43 to 50

Using a twin screw extruder TEX44SS having two inlets with an L/D value of 38 (assuming that the distance between a first inlet and the top of a screw is 100, a second inlet is apart by 70 from the first inlet) (The Japan Steel Works, Ltd.), polyethylene terephthalate, polyarylate and a phosphite compound dried at a water content of 100 ppm or less were dry-blended in the compounding ratio shown in Table 14, and then introduced through the first inlet into the extruder, while a phosphorus based flame retardant shown in Table 14 was introduced through the second inlet into the extruder, and the mixture was melt-kneaded once at a Q/R value of 0.5 by rotation in the same direction at a cylinder temperature set at 250 to 270° C., to give a composition. The resulting composition was dried at a water content of 100 ppm or less, and its molten polymer was discharged at 260 to 280° C. through a spinneret having a nozzle having a round section of 0.5 mm in diameter, cooled in a water bath at a water temperature of 50° C. placed in a position 30 cm below the spinneret, and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

TABLE 14

| | Examples | | | | | | | |
|---|---|---|---|---|---|---|---|---|
| | 43 | 44 | 45 | 46 | 47 | 48 | 49 | 50 |
| Polyethylene terephthalate*3 (parts) | 85 | 85 | 75 | 85 | 75 | 85 | | |
| Polyethylene terephthalate*1 (parts) | | | | | | | 75 | |
| Polyethylene terephthalate*16 (parts) | | | | | | | | 75 |
| Polyarylate*4 (parts) | 15 | | | 15 | 25 | | | 25 |
| Polyarylate*14 (parts) | | 15 | 25 | | | 15 | 25 | |
| Phosphorus based flame retardant*15 (parts) | 10 | 10 | 10 | | | | | |
| Phosphorus based flame retardant*9 (parts) | | | | | 10 | 10 | | |
| Phosphorus based flame retardant*17 (parts) | | | | 10 | | | 10 | 10 |
| Phosphite-based antioxidant*6 (parts) | 1 | 1 | 3 | 1 | | 1 | | 2 |
| Phosphite-based antioxidant*8 (parts) | | | | | 3 | | 2 | |

*1: Velpet EFG-10, IV = 0.60, manufactured by Kanebo Gosen Co., Ltd.
*16: Flakes, IV = 0.70 to 0.75, prepared from used PET bottles.

TABLE 14-continued

| | Examples | | | | | | | |
|---|---|---|---|---|---|---|---|---|
| | 43 | 44 | 45 | 46 | 47 | 48 | 49 | 50 |

*17: FP-700 manufactured by Asahi Denka Kogyo K.K.

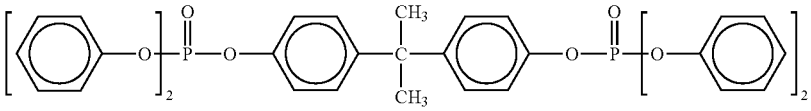

The resulting composition and fiber were evaluated for the diameter/number of dispersed particles of the component (B), strength and elongation, heat shrinkage, limit oxygen index, dripping and iron setting. The results are shown in Table 15.

TABLE 15

| | Examples | | | | | | | |
|---|---|---|---|---|---|---|---|---|
| | 43 | 44 | 45 | 46 | 47 | 48 | 49 | 50 |
| Average diameter/number of dispersed particles of component (B) | | | | | | | | |
| Major axis (μm) | 1.2 | 0.9 | 1.6 | 1.5 | 1.4 | 1.0 | 1.6 | 1.5 |
| Minor axis (μm) | 1.0 | 0.6 | 1.2 | 1.3 | 1.0 | 0.7 | 1.2 | 1.0 |
| Number of protrusions/100 $\mu m^2$ | 9 | 13 | 6 | 5 | 6 | 13 | 6 | 7 |
| Finiteness (dtex) | 50 | 48 | 48 | 52 | 52 | 50 | 48 | 50 |
| Strength (cN/dtex) | 1.8 | 1.8 | 1.7 | 1.9 | 1.7 | 2.0 | 1.9 | 1.7 |
| Elongation (%) | 57 | 53 | 40 | 48 | 39 | 55 | 46 | 43 |
| Degree of shrinkage at 180° C. (%) | 3 | 3 | 2 | 3 | 3 | 4 | 3 | 3 |
| Limit oxygen index | 25.2 | 25.3 | 26.0 | 25.3 | 26.2 | 25.5 | 26.0 | 26.2 |
| Dripping | ○ | ○ | ○ | ○ | ○ | ○ | ○ | ○ |
| Iron setting (setting at 180° C.) | | | | | | | | |
| Fusion | ○ | ○ | ○ | ○ | ○ | ○ | ○ | ○ |
| Shrinkage/filament cutting | ○ | ○ | ○ | ○ | ○ | ○ | ○ | ○ |
| Rod-out property | ○ | ○ | ○ | ○ | ○ | ○ | ○ | ○ |
| Curling retention | ○ | ○ | ○ | ○ | ○ | ○ | ○ | ○ |

Examples 51 to 55

Polyethylene terephthalate, polyarylate, a phosphorus type flame retardant and a phosphite compound dried at a water content of 100 ppm or less were dry-blended in the compounding ratio shown in Table 16, and the mixture was melt-kneaded at a Q/R value of 1.5 by rotation in the same direction at a cylinder temperature set at 250 to 270° C. with a twin screw extruder PCM43 (Ikegai Co., Ltd.) having an L/D value of 20, and the resulting composition was dried at a water content of 100 ppm or less. The same melt-kneading operation was repeated again. The composition obtained by melt-kneading was dried at a water content of 100 ppm or less, and then its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

TABLE 16

| | Examples | | | | |
|---|---|---|---|---|---|
| | 51 | 52 | 53 | 54 | 55 |
| Polyethylene terephthalate*3 (parts) | 75 | 85 | | | |
| Polyethylene terephthalate*1 (parts) | | | 85 | 75 | |
| Polyethylene terephthalate*16 (parts) | | | | | 75 |
| Polyarylate*4 (parts) | | 15 | 15 | | 25 |
| Polyarylate*14 (parts) | 25 | | | 25 | |
| Phosphorus based flame retardant*15 (parts) | 10 | 10 | 10 | | |
| Phosphorus based flame retardant*17 (parts) | | | | 10 | 10 |
| Phosphite-based antioxidant*6 (parts) | 3 | | 3 | | 2 |

TABLE 16-continued

| | Examples | | | | |
|---|---|---|---|---|---|
| | 51 | 52 | 53 | 54 | 55 |
| Phosphite-based antioxidant*8 (parts) | | 2 | | 2 | |

The resulting composition and fiber were evaluated for the diameter/number of dispersed particles of the component (B), strength and elongation, heat shrinkage, limit oxygen index, dripping and iron setting. The results are shown in Table 17.

TABLE 17

| | Examples | | | | |
|---|---|---|---|---|---|
| | 51 | 52 | 53 | 54 | 55 |
| Average diameter/number of dispersed particles of component (B) | | | | | |
| Major axis (μm) | 2.7 | 3.3 | 2.3 | 3.2 | 2.9 |
| Minor axis (μm) | 2.2 | 2.3 | 1.7 | 2.2 | 2.0 |
| Number/100 $\mu m^2$ | 14 | 11 | 12 | 16 | 10 |
| Finiteness (dtex) | 50 | 48 | 48 | 50 | 53 |
| Strength (cN/dtex) | 1.9 | 2.1 | 2.1 | 1.7 | 1.9 |
| Elongation (%) | 40 | 53 | 54 | 41 | 45 |
| Shrinkage at 180° C. (%) | 3 | 3 | 4 | 3 | 4 |
| Limit oxygen index | 26.2 | 25.8 | 26.0 | 26.0 | 26.2 |
| Dripping | ○ | ○ | ○ | ○ | ○ |
| Iron setting (setting at 180° C.) | | | | | |
| Fusion | ○ | ○ | ○ | ○ | ○ |
| Shrinkage/filament cutting | ○ | ○ | ○ | ○ | ○ |
| Rod-out property | ○ | ○ | ○ | ○ | ○ |
| Curling retention | ○ | ○ | ○ | ○ | ○ |

Examples 56 to 61

Polyethylene terephthalate, polyarylate and a phosphite compound dried at a water content of 100 ppm or less were dry-blended in the compounding ratio shown in Table 18, and melt-kneaded at an L/D value of 20 by rotation in the same direction at a cylinder temperature set at 250 to 270° C. with a twin screw extruder PCM43 (Ikegai Co., Ltd.) having a Q/R value of 1.5, to give a composition. 10 parts by weight of the phosphorus based fluorescent flame retardant shown in Table 18 was added to 100 parts by weight of the composition dried at a water content of 100 ppm or less, and the melt-kneading operation was repeated under the same conditions. The composition obtained by melt-kneading was dried at a water content of 100 ppm or less, and then its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

TABLE 18

| | Examples | | | | | |
|---|---|---|---|---|---|---|
| | 56 | 57 | 58 | 59 | 60 | 61 |
| Polyethylene terephthalate*3 (parts) | 85 | 85 | 75 | 85 | | |
| Polyethylene terephthalate*1 (parts) | | | | | 85 | |
| Polyethylene terephthalate*16 (parts) | | | | | | 75 |
| Polyarylate*4 (parts) | 15 | | 25 | | 15 | 25 |
| Polyarylate*14 (parts) | | 15 | | 15 | | |
| Phosphorus based flame retardant*15 (parts) | 10 | | | | | |
| Phosphorus based flame retardant*9 (parts) | | 10 | 10 | 10 | | |
| Phosphorus based flame retardant*17 (parts) | | | | | | 10 |
| Phosphite-based antioxidant*6 (parts) | 1 | 1 | | 1 | 2 | 2 |
| Phosphite-based antioxidant*8 (parts) | | | 3 | | | |

The resulting composition and fiber were evaluated for the diameter/number of dispersed particles of the component (B), strength and elongation, heat shrinkage, limit oxygen index, dripping and iron setting. The results are shown in Table 19.

TABLE 19

| | 56 | 57 | 58 | 59 | 60 | 61 |
|---|---|---|---|---|---|---|
| Average diameter/number of dispersed particles of component (B) | | | | | | |
| Major axis (μm) | 2.0 | 2.3 | 1.8 | 2.2 | 2.0 | 2.1 |
| Minor axis (μm) | 1.7 | 1.6 | 1.4 | 1.5 | 1.5 | 1.8 |
| Number of protrusions/100 $\mu m^2$ | 8 | 6 | 10 | 9 | 10 | 9 |
| Finiteness (dtex) | 47 | 52 | 48 | 51 | 52 | 53 |
| Strength (cN/dtex) | 2.1 | 2.0 | 2.1 | 1.8 | 2.0 | 1.8 |
| Elongation (%) | 56 | 53 | 40 | 48 | 52 | 42 |
| Degree of shrinkage at 180° C. (%) | 2 | 3 | 3 | 4 | 3 | 3 |
| Limit oxygen index | 25.4 | 25.6 | 26.0 | 25.3 | 25.2 | 25.8 |
| Dripping | ○ | ○ | ○ | ○ | ○ | ○ |
| Iron setting (setting at 180° C.) | | | | | | |
| Fusion | ○ | ○ | ○ | ○ | ○ | ○ |
| Shrinkage/filament cutting | ○ | ○ | ○ | ○ | ○ | ○ |
| Rod-out property | ○ | ○ | ○ | ○ | ○ | ○ |
| Curling retention | ○ | ○ | ○ | ○ | ○ | ○ |

Comparative Examples 10 to 11

Polyethylene terephthalate, polyarylate and a phosphorus based flame retardant dried at a water content of 100 ppm or less were dry-blended in the compounding ratio shown in Table 20, and then melt-kneaded at a Q/R value of 0.5 by rotation in the same direction at a cylinder temperature set at 250 to 270° C. with a twin screw extruder TEX44SS (The Japan Steel Works, Ltd.) having two inlets with a L/D value of 38, to give a composition. The resulting composition was dried at a water content of 100 ppm or less, and then its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

TABLE 20

| | Examples | | Comparative Examples | | |
|---|---|---|---|---|---|
| | 62 | 63 | 10 | 11 | 12 |
| Polyethylene terephthalate*3 (parts) | 75 | 85 | 100 | 75 | 75 |
| Polyarylate*4 (parts) | 25 | 15 | | 25 | 25 |
| Phosphorus based flame retardant*15 (parts) | 10 | 10 | 10 | 10 | 10 |
| Phosphite-based antioxidant*6 (parts) | 1 | 1 | | | |
| Phenol-based antioxidant*2 (parts) | | | | | 1 |

*2Adekastab AO-60 manufactured by Asahi Denka Kogyo K.K.

Example 62

Polyethylene terephthalate, polyarylate, a phosphorus based flame retardant and a phosphite compound dried at a water content of 100 ppm or less were dry-blended in the ratio shown in Table 20, and then melt-kneaded at a Q/R value of 3.0 by rotation in the same direction at a cylinder temperature set at 250 to 270° C. with a twin screw extruder PCM43 (Ikegai Co., Ltd.) having an L/D of 20, to give a composition. The resulting composition was dried at a water content of 100 ppm or less, and its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

Comparative Example 12

Polyethylene terephthalate, polyarylate, a phosphorus based flame retardant and a phosphite compound dried at a water content of 100 ppm or less were dry-blended in the ratio shown in Table 20, and then melt-kneaded at a Q/R value of 1.5 by rotation in the same direction at a cylinder temperature set at 250 to 270° C. with a twin screw extruder TEX44SS (The Japan Steel Works, Ltd.) having an L/D value of 38, to give a composition. The resulting composition was dried at a water content of 100 ppm or less, and its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

Examples 63

Polyethylene terephthalate, polyarylate, a phosphorus based flame retardant and a phosphite compound dried at a water content of 100 ppm or less were dry-blended in the ratio shown in Table 20, and then melt-kneaded at a Q/R value of 0.5 with a twin screw extruder BT-30-S2S (Plastic Kogaku Kenkyusho Co., Ltd.) having an L/D value of 60 by rotation in the same direction at a cylinder temperature set at 250 to 270° C., and the resulting composition was dried at a water content of 100 ppm or less. The same melt-kneading operation was repeated again. The resulting composition was dried at a water content of 100 ppm or less, and then its molten polymer was discharged at 260 to 280° C. through a spinneret having a nozzle having a round section of 0.5 mm in diameter, cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 180° C. and heat-treated to give polyester-based fiber (multifilament) having a single fiber finiteness of about 50 dtex.

The resulting composition and fiber were evaluated for the diameter/number of dispersed particles of the component (B), strength and elongation, heat shrinkage, limit oxygen index, dripping and iron setting. The results are shown in Table 21.

TABLE 21

| | Examples | | Comparative Examples | | |
|---|---|---|---|---|---|
| | 62 | 63 | 10 | 11 | 12 |
| Average diameter/number of dispersed particles of component (B) | | | | | |
| Major axis (μm) | 25 | 20 | — | — | — |
| Minor axis (μm) | 18 | 17 | — | — | — |
| Number of protrusions/100 $\mu m^2$ | 1 | 1 | — | — | — |
| Finiteness (dtex) | 48 | 53 | 50 | 52 | 51 |
| Strength (cN/dtex) | 1.6 | 1.6 | 2.5 | 2.0 | 1.7 |
| Elongation (%) | 40 | 42 | 72 | 46 | 38 |
| Degree of shrinkage at 180° C. (%) | 11 | 7 | 9 | 15 | 8 |
| Limit oxygen index | 25.5 | 25.1 | 25.0 | 25.3 | 25.4 |
| Dripping | Δ | Δ | X | Δ | Δ |
| Iron setting (setting at 180° C.) | | | | | |
| Fusion | Δ | X | Δ | X | X |
| Shrinkage/filament cutting | Δ | Δ | Δ | X | Δ |
| Rod-out property | Δ | Δ | Δ | Δ | Δ |
| Curling retention | ○ | — | Δ | — | — |

In Comparative Examples 11 and 12, the polyethylene terephthalate and polyarylate were incompatible with each other to undergo phase separation, but because they were not dispersed thus failing to form a sea island structure, the diameter of dispersed particles could not be evaluated.

Examples 64 to 68

A phosphorus based flame retardant and a phosphite compound were mixed, in the ratio shown in Table 22, with 100 parts by weight of a mixture of polyester and polyarylate dried at a water content of 100 ppm or less, and 1.5 parts of coloring polyester pellet PESM6100 BLACK (carbon black content of 30% manufactured by Dainichiseika Color & Chemicals Mgf. Co., Ltd.) was dry-blended therewith, then fed to a twin-screw extruder (ϕ50 mm, L/D=30) having a gear pump (capacity 1.2 cc) and spinnerets (ϕ0.5 mm, 20 holes, round section), melt-kneaded and spun under the conditions of a cylinder temperature of 290° C., a spinning head temperature of 275° C. and a Q/R value of 1.5. The spun filament from the spinneret was cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 200° C. and heat-treated to give polyester-based fiber (multifilament) having a single fiber finiteness of about 50 dtex.

TABLE 22

| | Examples | | | | | | | | | |
|---|---|---|---|---|---|---|---|---|---|---|
| | 64 | 65 | 66 | 67 | 68 | 69 | 70 | 71 | 72 | 73 |
| Polyester*3 (parts) | 85 | 75 | | 50 | 85 | 85 | 85 | 75 | | |
| Polyester*18 (parts) | | | 75 | | | | | | | |
| Polyester*19 (parts) | | | | 25 | | | | | | |
| Polyester*20 (parts) | | | | | | | | | 75 | |
| Polyester*21 (parts) | | | | | | | | | | 85 |
| Polyarylate*4 (parts) | 15 | 25 | 25 | 25 | 15 | 15 | 15 | 25 | 25 | 15 |
| Phosphorus based flame retardant*15 (parts) | 10 | 10 | 10 | 5 | | 10 | 10 | 10 | 10 | 10 |
| Phosphorus based flame retardant*17 (parts) | | | | | 10 | | | | | |
| Phosphite-based antioxidant*6 (parts) | 1 | 1 | 1 | 1 | 1 | 1 | | | 1 | 1 |
| Phosphite-based antioxidant*8 (parts) | | | | | | | 1 | 1 | | |

*3Velpet EFG-85A, IV = 0.85, manufactured by Kanebo Gosen Co., Ltd.
*18SA-1206, IV = 1.07, manufactured by Unitika Ltd.
*19SBT-3 manufactured by Huvis.
*20Easter 6763 manufactured by Eastman Chemical Company
*21NOPLA KE831 manufactured by KOLON.
*4U-100, IV = 0.60, manufactured by Unitika Ltd.
*15PX-200 manufactured by Daihachi Kagaku Co., Ltd.
*17FP-700 manufactured by Asahi Denka Kogyo K.K.
*6Adekastab PEP-36 manufactured by Asahi Denka Kogyo K.K.
*8Adekastab 522A manufactured by Asahi Denka Kogyo K.K.

Examples 69 to 73

A phosphorus based flame retardant and a phosphite-based antioxidant were mixed, in the ratio shown in Table 22, with 100 parts by weight of a mixture of polyester and polyarylate dried at a water content of 100 ppm or less, and 1.5 parts by weight of coloring polyester pellet PESM6100 BLACK (carbon black content of 30% manufactured by Dainichiseika Color & Chemicals Mgf. Co., Ltd.) was dry-blended therewith. Using a tandem extruder (first extruder: twin screw extruder, ϕ40 mm, L/D=25; second extruder: single screw extruder, ϕ50 mm, L/D=25) having a gear pump (capacity 1.2 cc) and spinnerets (ϕ0.5 mm, 20 holes having a round section), the composition was melt-kneaded and spun at a Q/R value of 1.5 at a cylinder temperature of 290° C. in the first extruder and at a cylinder temperature of 280° C. and a spinning head temperature of 270° C. in the second extruder. The spun filament from the spinneret was cooled in a water bath at a water temperature of 50° C. placed in a position 30 mm below the spinneret and wound at a rate of 100 m/min. to give a spun filament. The resulting spun filament was stretched to give a 4-fold stretched filament in a hot water bath at 80° C., then wound at a rate of 100 m/min. on a heat roll heated at 200° C. and heat-treated to give polyester-based fiber (multifilament) having a single fiber finiteness of about 50 dtex.

Comparative Example 13

75 parts by weight of polyethylene terephthalate (Velpet EFG-10 manufactured by Kanebo Gosen Co., Ltd.) dried at a water content of 100 ppm or less, 25 parts by weight of polyarylate (U-100 manufactured by Unitika Ltd.), 10 parts by weight of triphenyl phosphate and 1.5 parts by weight of coloring polyester pellet PESM6100 BLACK (carbon black content of 30% manufactured by Dainichiseika Color & Chemicals Mgf. Co., Ltd.) were dry-blended to give-polyester-based fiber (multifilament) having a single fiber finiteness of about 53 dtex in the same manner as in Example 64.

Comparative Example 14

75 parts by weight of polyethylene terephthalate (Velpet EFG-10 manufactured by Kanebo Gosen Co., Ltd.) dried at a water content of 100 ppm or less, 25 parts by weight of polyarylate (U-100 manufactured by Unitika Ltd.), 10 parts by weight of triphenyl phosphate and 1.5 parts by weight of coloring polyester pellet PESM6100 BLACK (carbon black content of 30% manufactured by Dainichiseika Color & Chemicals Mgf. Co., Ltd.) were dry-blended to give polyester-based fiber (multifilament) having a single fiber finiteness of about 51 dtex in the same manner as in Example 69.

The fibers obtained in Examples 64 to 73 and Comparative Examples 13 to 14 were examined for strength, elongation and heat shrinkage, for limit oxygen index and dripping with respect to flame retardancy, for cold setting, curling retention and iron setting with respect to artificial hair, and for gloss and the average size/number of surface protrusions. The results are shown in Tables 23 and 24.

TABLE 23

| | Examples | | | | | | | | | |
|---|---|---|---|---|---|---|---|---|---|---|
| | 64 | 65 | 66 | 67 | 68 | 69 | 70 | 71 | 72 | 73 |
| Finiteness (dtex) | 53 | 51 | 49 | 52 | 50 | 51 | 48 | 50 | 51 | 49 |
| Strength (cN/dtex) | 2.2 | 2.5 | 2.7 | 2.0 | 2.0 | 1.9 | 1.9 | 2.1 | 1.8 | 2.3 |
| Elongation (%) | 63 | 48 | 54 | 44 | 62 | 55 | 53 | 43 | 75 | 48 |
| Degree of shrinkage at 180° C. (%) | 3 | 3 | 2 | 3 | 3 | 3 | 3 | 3 | 8 | 2 |
| Limit oxygen index | 25.2 | 26.3 | 25.1 | 27.3 | 25.2 | 25.1 | 25.0 | 25.2 | 25.3 | 25.5 |

TABLE 23-continued

| | Examples | | | | | | | | | |
|---|---|---|---|---|---|---|---|---|---|---|
| | 64 | 65 | 66 | 67 | 68 | 69 | 70 | 71 | 72 | 73 |
| Dripping | ○ | ○ | ○ | Δ | ○ | ○ | ○ | ○ | Δ | ○ |
| Average size/number of surface protrusions | | | | | | | | | | |
| Major axis (μm) | 4.1 | 4.8 | 4.5 | 3.4 | 3.9 | 5.0 | 5.3 | 6.3 | 9.2 | 5.3 |
| Minor axis (μm) | 3.0 | 3.2 | 3.3 | 2.4 | 2.6 | 3.2 | 3.4 | 3.8 | 6.3 | 3.3 |
| Height (μm) | 0.8 | 1.2 | 1.0 | 0.6 | 0.7 | 1.0 | 1.1 | 1.4 | 1.8 | 1.2 |
| Number of protrusions/100 $\mu m^2$ | 3 | 5 | 3 | 4 | 4 | 2 | 2 | 5 | 4 | 3 |
| Gloss | ◎ | ○ | ○ | ○ | ○ | ◎ | ◎ | ○ | Δ | ○ |
| Iron setting (setting at 180° C.) | | | | | | | | | | |
| Fusion | ○ | ○ | ○ | ○ | ○ | ○ | ○ | ○ | Δ | ○ |
| Shrinkage/filament cutting | ○ | ○ | ○ | ○ | ○ | ○ | ○ | ○ | ○ | ○ |
| Rod-out property | ○ | ○ | ○ | ○ | ○ | ○ | ○ | ○ | Δ | ○ |
| Curling retention | ○ | ○ | ○ | ○ | ○ | ○ | ○ | ○ | ○ | ○ |

The fibers in Examples 64 to 73 formed fine protrusions on the surfaces thereof to exhibit a suitable matting effect.

TABLE 24

| | Examples | |
|---|---|---|
| | 13 | 14 |
| Finiteness (dtex) | 53 | 51 |
| Strength (cN/dtex) | 2.5 | 2.7 |
| Elongation (%) | 48 | 54 |
| Shrinkage at 180° C. (%) | 8 | 6 |
| Limit oxygen index | 24.8 | 25.1 |
| Dripping | X | X |
| Average size/number of surface protrusions | | |
| Major axis (μm) | — | — |
| Minor axis (μm) | — | — |
| Height (μm) | — | — |
| Number/100 $\mu m^2$ | — | — |
| Gloss | X | X |
| Iron setting (setting at 180° C.) | | |
| Fusion | X | X |
| Shrinkage/filament cutting | Δ | Δ |
| Rod-out property | X | X |
| Curling retention | ○ | ○ |

The average diameter of dispersed particles of the component (B) in Comparative Examples 13 and 14 were poor in dispersion and could not be evaluated.

INDUSTRIAL APPLICABILITY

According to the present invention, there can be obtained polyester-based fiber which maintains physical properties of usual polyester fiber, such as heat resistance, strength and elongation and is excellent in setting ability with controlled gloss of the fiber, as well as artificial hair using the same. Melt kneading and melt spinning are carried out simultaneously or continuously, whereby the production process can be shortened, and polyester-based fiber can be produced efficiently at lower costs.

The invention claimed is:

1. A polyester-based artificial hair comprising a composition containing (A) polyester consisting of at least one kind of polyalkylene terephthalate or at least one kind of copolymerized polyester based on polyalkylene terephthalate, (B) polyarylate, (C) a phosphite compound and (D) a phosphorus based flame retardant.

2. The polyester-based artificial hair according to claim 1, wherein the ratio by weight of the polyester (A) to the polyarylate (B), that is, (A)/(B), is from 90/10 to 70/30, and the amount of the phosphite compound (C) added is 0.05 to 5 parts by weight based on 100 parts in total of the polyester (A) and polyarylate (B).

3. The polyester-based artificial hair according to claim 1, wherein the polyester (A) is at least one polymer selected from the group consisting of polyethylene terephthalate, polypropylene terephthalate and polybutylene terephthalate.

4. The polyester-based artificial hair according to claim 1, wherein the polyarylate (B) is polyarylate obtained from a mixture of terephthalic acid, a derivative thereof, isophthalic acid and a derivative thereof, and a bisphenol compound represented by the general formula (1):

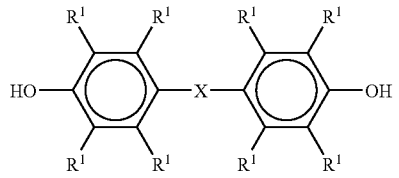

(1)

wherein $R^1$ groups represent a hydrogen atom or a $C_{1-10}$ hydrocarbon group, and may be the same or different, and X represents a methylene group, ethylidene group, isopropylidene group, carbonyl group, sulfonyl group, 1,3-phenylenediisopropylidene group or 1,4-phenylenediisopropylidene group.

5. The polyester-based artificial hair according to claim 1, wherein the phosphite compound (C) is at least one member selected from the group consisting of trialkyl phosphites, triallyl phosphites, alkylallyl phosphites and the phosphite compounds represented by the general formulae (2) to (5):

(2)

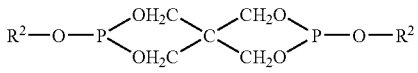

wherein $R^2$ groups represent a $C_{4-20}$ linear or branched hydrocarbon group, and may be the same or different, (3)

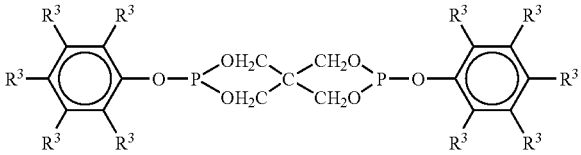

wherein $R^3$ groups represent a hydrogen atom or a $C_{1-10}$ hydrocarbon group, and may be the same or different, (4)

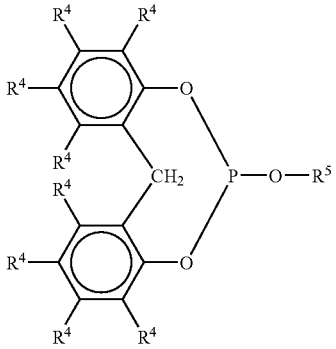

wherein $R^4$ groups represent a hydrogen atom or a $C_{1-10}$ hydrocarbon group, and may be the same or different, and $R^5$ represents a $C_{4-20}$ hydrocarbon group or a $C_{6-20}$ aromatic hydrocarbon group, (5)

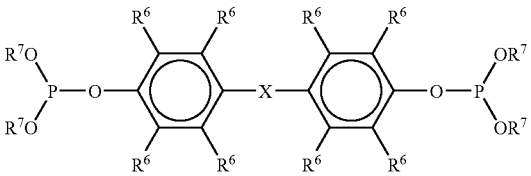

wherein $R^6$ groups represent a hydrogen atom or a $C_{1-10}$ hydrocarbon group, and may be the same or different, $R^7$ groups represent a $C_{4-20}$ hydrocarbon group or a $C_{6-20}$ aromatic hydrocarbon group, and may be the same or different, and X represents a methylene group, ethylidene group, isopropylidene group, carbonyl group, sulfonyl group, 1,3-phenylenediisopropylidene group or 1,4-phenylenediisopropylidene group.

6. The polyester-based artificial hair according to claim 1, wherein the polyarylate (B) having dimensions of 0.1 to 15 μm in diameter and 0.05 to 10 μm in short diameter is dispersed in the polyester (A).

7. The polyester-based artificial hair according to claim 1, wherein the ratio by weight of the polyester (A) to the polyarylate (A), that is, (A)/(B), is from 90/10 to 70/30, and the amount of the phosphorus based flame retardant (D) added is such that the amount of phosphorus atom of the flame retardant (D) is 0.05 to 10 parts by weight based on 100 parts in total of the polyester (A) and polyarylate (B).

8. The polyester-based artificial hair according to claim 1, wherein the phosphorus based flame retardant (D) is at least one compound selected from the group consisting of a phosphate compound, a phosphonate compound, a phosphinate compound, a phosphine oxide compound, a phosphonite compound, a phosphinite compound, a phosphine compound and a condensed phosphate compound.

9. The polyester-based artificial hair according to claim 1, wherein the phosphorus based flame retardant (D) is a condensed phosphate compound represented by the general formula (6):

(6)

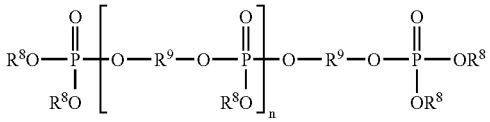

wherein $R^8$ groups represent a monovalent aromatic hydrocarbon group or aliphatic hydrocarbon group, and may be the same or different; $R^9$ represents a divalent aromatic hydrocarbon group, and when two or more $R^9$ groups are present, the groups may be the same or different; and n is 0 to 15.

10. The polyester-based artificial hair according to claim 1, wherein the flame retardant is a reactive phosphorus based flame retardant.

11. The polyester-based artificial hair according to claim 10, wherein the polyester (A) is a copolymerized thermoplastic polyester comprising a reactive phosphorus based flame retardant copolymerized therein.

12. The polyester-based artificial hair according to claim 10, wherein the reactive phosphorus based flame retardant is at least one member selected from the group consisting of phosphorus-containing compounds represented by the general formulae (7) to (12):

(7)

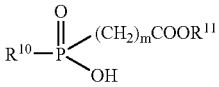

wherein $R^{10}$ represents a $C_{1-20}$ aliphatic hydrocarbon group or a $C_{6-12}$ aromatic hydrocarbon group, $R^{11}$ represents a hydrogen atom or a $C_{1-20}$ aliphatic hydrocarbon group, and m is an integer of 1 to 11, (8)

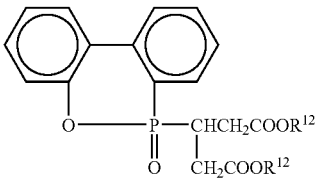

wherein $R^{12}$ groups represent a hydrogen atom or a $C_{1-20}$ aliphatic hydrocarbon group, and may be the same or different, (9)

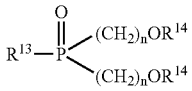

wherein $R^{13}$ represents a $C_{1-20}$ aliphatic hydrocarbon group or a $C_{6-12}$ aromatic hydrocarbon group, $R^{14}$ groups represent a hydrogen atom or a $C_{1-20}$ aliphatic hydrocarbon group, and may be the same or different, and n is an integer of 1 to 12, (10)

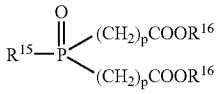

wherein $R^{15}$ represents a $C_{1-20}$ aliphatic hydrocarbon group or a $C_{6-12}$ aromatic hydrocarbon group, $R^{16}$ groups represent a hydrogen atom or a $C_{1-20}$ aliphatic hydrocarbon group, and may be the same or different, and p is an integer of 1 to 11, (11)

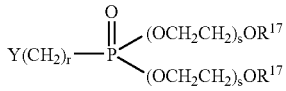

wherein $R^{17}$ groups represent a hydrogen atom or a $C_{1-20}$ aliphatic hydrocarbon group, and may be the same or different, Y represents a hydrogen atom, a methyl group or a $C_{6-12}$ aromatic hydrocarbon group, and r and s each represent an integer of 1 to 20, and (12)

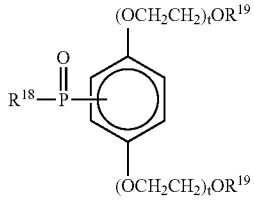

wherein $R^{18}$ represents a $C_{1-20}$ aliphatic hydrocarbon group or a $C_{6-12}$ aromatic hydrocarbon group, $R^{19}$ represents a hydrogen atom or a $C_{1-20}$ aliphatic hydrocarbon group, and may be the same or different, and t is an integer of 1 to 20.

13. A method of producing the polyester-based artificial hair described in claim 6, wherein the components (A), (B), (C) and (D) are melt-kneaded by a twin-screw extruder under the conditions of a kneading temperature of 240 to 310° C. and a Q/R value of 0.2 to 2.0.

14. A method of producing the polyester-based artificial hair described in claim 1, in which the polyester-based artificial hair is obtained by directly melt-spinning the composition with an extruder having a gear pump and spinnerets.

15. The polyester-based artificial hair according to claim 1, which has fine protrusions on the surface of the artificial hair.

16. The polyester-based artificial hair according to claim 15, wherein the major axis of the protrusion is 0.2 to 20 μm, the minor axis is 0.1 to 10 μm, and the height is 0.1 to 2 μm, and the number of protrusions per 100 $\mu m^2$ artificial hair surface is at least 1.

17. Flame retardant polyester-based artificial hair comprising the polyester-based artificial hair described in claim 1.

* * * * *

UNITED STATES PATENT AND TRADEMARK OFFICE

CERTIFICATE OF CORRECTION

PATENT NO. : 7,332,563 B2
APPLICATION NO. : 10/482646
DATED : February 19, 2008
INVENTOR(S) : Masuda et al.

It is certified that error appears in the above-identified patent and that said Letters Patent is hereby corrected as shown below:

In column 15, line 47, replace

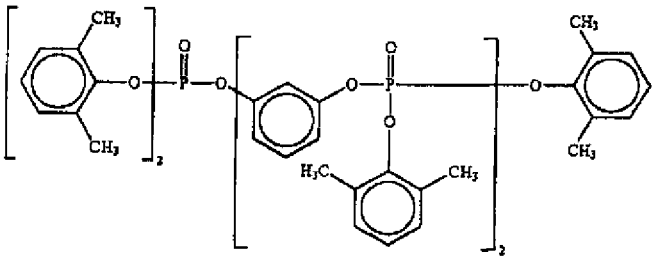

with

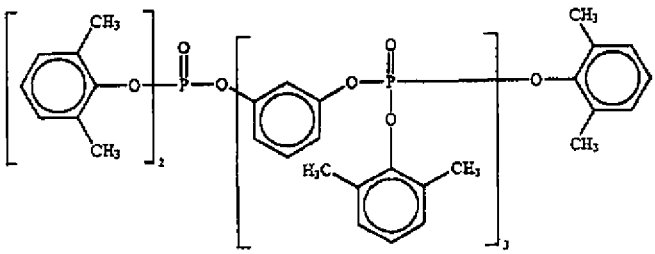

Signed and Sealed this

Ninth Day of June, 2009

John Doll

JOHN DOLL
*Acting Director of the United States Patent and Trademark Office*